US007255135B2

(12) United States Patent
Ishikawa et al.

(10) Patent No.: US 7,255,135 B2
(45) Date of Patent: Aug. 14, 2007

(54) REINFORCING STEEL BAR TYPING MACHINE

(75) Inventors: Noboru Ishikawa, Tokyo (JP); Ichiro Kusakari, Tokyo (JP); Takahiro Nagaoka, Tokyo (JP); Osamu Itagaki, Tokyo (JP); Yasushi Yokochi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 10/484,632

(22) PCT Filed: Jul. 24, 2002

(86) PCT No.: PCT/JP02/07492

§ 371 (c)(1),
(2), (4) Date: Aug. 30, 2004

(87) PCT Pub. No.: WO03/010047

PCT Pub. Date: Feb. 6, 2003

(65) Prior Publication Data

US 2005/0005991 A1 Jan. 13, 2005

(30) Foreign Application Priority Data

| | | |
|---|---|---|
| Jul. 25, 2001 | (JP) | 2001-225202 |
| Jul. 30, 2001 | (JP) | 2001-230654 |
| Jul. 30, 2001 | (JP) | 2001-230666 |
| Jul. 30, 2001 | (JP) | 2001-230672 |
| Aug. 21, 2001 | (JP) | 2001-250911 |

(51) Int. Cl.
*B21F 15/04* (2006.01)

(52) U.S. Cl. ..... 140/119; 140/57; 140/93.6

(58) Field of Classification Search ..... 140/93 A, 140/57, 119, 93.6, 122, 118
See application file for complete search history.

(56) References Cited

U.S. PATENT DOCUMENTS

| | | | | |
|---|---|---|---|---|
| 3,391,715 A | * | 7/1968 | Thompson | 140/93.6 |
| 4,508,030 A | * | 4/1985 | Grenon | 100/26 |
| 4,655,264 A | | 4/1987 | Dilley | |
| 4,865,087 A | * | 9/1989 | Geiger | 140/119 |
| 5,279,336 A | | 1/1994 | Kusakari et al. | |
| 5,558,012 A | | 9/1996 | Yamashima et al. | |
| 5,947,166 A | * | 9/1999 | Doyle et al. | 140/119 |

FOREIGN PATENT DOCUMENTS

| | | |
|---|---|---|
| EP | 167795 A1 | 1/1986 |
| JP | 57-125111 A | 8/1982 |

* cited by examiner

*Primary Examiner*—Dmitry Suhol
(74) *Attorney, Agent, or Firm*—Morgan, Lewis & Bockius LLP

(57) ABSTRACT

A front end of a ball screw shaft driven by a motor is connected with a binding line clamp apparatus (513) including three clamp plates (514, 515, 516). The left and right clamp plates (515, 516) are constituted to be brought into elastic contact with the center clamp plate (515) and close the left and right clamp plates by operation of cams (527, 528) when a sleeve is moved rearward. In a state of opening the clamp plates, a binding line is fed out to an upper side by passing through an interval between the right clamp plate (515) and the center clamp plate (514), formed in a loop shape and moved into an interval between the left clamp plate (516) and the center clamp plate (517). When the sleeve is moved rearward by driving to rotate a ball screw shaft, the left and right clamp plates are closed to grasp a front end and a rear end of the binding line loop and thereafter, the binding line clamp apparatus is rotated to twist the binding line to bind a reinforcing bar.

15 Claims, 37 Drawing Sheets

REINFORCING STEEL BAR TYPING MACHINE

TECHNICAL FIELD

The present invention relates to a reinforcing bar binder and a grasp mechanism of a binding line in a reinforcing bar binder. Particularly, the invention relates to a binding line clamp apparatus of a reinforcing bar binder constituted to grasp an end portion of a binding line to twist, a reinforcing bar binder constituted to pertinently control a length of a binding line in accordance with a reinforcing bar diameter and a reinforcing bar binder reducing an amount of consuming a binding line.

BACKGROUND ART

A reinforcing bar binder is comprising a binding line feed mechanism for feeding out a binding line of a wire or the like wound around a reel to be wound around a reinforcing bar, and a binding line twist mechanism for twisting the binding line wound around the reinforcing bar to bind, and the binding line feed mechanism and the binding line twist mechanism are successively operated by trigger operation to carry out binding operation of 1 cycle.

When a circular arc shape nose of the reinforcing bar binder is hung around the reinforcing bar and a trigger lever is pulled, the binding line is fed out around an inner peripheral face of a nose by the binding line feed mechanism to form a biding line loop at a surrounding of the reinforcing bar, a rear end of the binding line loop is cut by a cutter mechanism, a pair of hook type hooks of the binding line twist mechanism are closed to grasp the binding line loop to thereafter rotate and the binding line loop is twisted to bind the reinforcing bar.

The reinforcing bar binder of a prior art is constituted to turn the binding line around the reinforcing bar by two rotations or more and catch a middle portion of the binding line loop remote from a front end and a rear end thereof by the pair of hooks and this is because when portions of the binding line at a vicinity of the front end or the rear end is caught, in rotating the hooks, the front end or the rear end is drawn out from the hooks to disengage the loop and binding cannot be carried out. Therefore, lengths of both end portions of the binding line extended from the portion grasped and twisted by the hooks are prolonged, the portions are projected at the surrounding of the reinforcing bar to bring about a drawback that the binding line is projected from a surface of concrete when concrete is cast and also an amount of consuming the binding line is large.

Further, the reinforcing bar binder of the prior art poses a problem that the amount of consuming the binding line is large since the binding line is turned around the reinforcing bar by two rotation or more and the length of the binding line to be fed out is constant regardless of the diameter of the reinforcing bar. Further, when the diameter of the reinforcing bar is small, an amount of twisting the binding line is increased, a long time period required for twisting is taken, the binding line cannot sufficiently be tightened and a restraining force may become insufficient. Further, since the length of the twisted portion is long, when concrete is cast, the binding line may be projected from the surface of the concrete to thereby cause a problem in finishing.

Further, according to the reinforcing bar binder of the prior art, when the nose in the circular arc shape of the reinforcing bar binder is hung to the reinforcing bar and the trigger lever is pulled, the binding line is fed out along a guide groove of an inner peripheral face of the nose by the binding line feed mechanism. The nose is provided with a forming portion opposed to the guide groove, the binding line is brought into contact with the forming portion when moving forward along the guide groove to curl to thereby form a loop around the surrounding of the reinforcing bar. Further, the binding line is cut by a binding line cut apparatus at a front end portion of the nose, the pair of hook type hooks of the binding line twist mechanism are closed to grub the binding line loop to thereafter rotate and twist the binding line loop to bind the reinforcing bar.

According to the reinforcing bar binder of the prior art, since the binding line is fed out bypassing an interval between the guide groove of the nose and the forming portion opposed to the guide groove, when the binding line cut apparatus is not arranged at the vicinities of the binding line twist mechanism and the forming portion, the binding line loop cannot be twisted by constituting a hindrance by the forming portion disposed on an inner side of the binding line loop. Further, when the binding line cut apparatus is arranged at the vicinity of the forming portion, since the binding line cut apparatus is disposed at a position remote from the binding line twist mechanism, an extra portion from a point of grasping the binding line to a terminal end portion of the loop is long, further, since the binding line needs to be wound around the reinforcing bar by two turns or more, there poses a problem that the amount of consuming the binding line is large and an outlook thereof in finishing to bind is poor. Further, even when the binding line cut apparatus is arranged at the vicinity of the forming portion, there is a case in which the binding line is caught by the fixed forming portion in twisting the binding line to give an unpleasant feeling to an operator.

DISCLOSURE OF THE INVENTION

Hence, there poses a technical problem to be resolved in order to improve binding finish by reducing extra portions projected from a twist portion of a binding line as less as possible and it is a first object of the invention to resolve the above-described problem.

Further, there poses a technical problem to be resolved in order to promote binding finish by pertinently controlling a length of a binding line in accordance with a diameter of a reinforcing bar and reduce a wasteful portion of a binding line and it is a second object of the invention to resolve the above-described problem.

Further, there poses a technical problem to be resolved in order to reduce an amount of consuming a binding line and carry out excellent binding operation in a reinforcing bar binder and it is a third object of the invention to resolve the above-described problem.

The invention is proposed to achieve the above-described objects and with regard to the first object, there is proposed a binding line clamp apparatus of a reinforcing bar binder which is a binding line grasp mechanism for grasping and twisting a loop of a binding line fed out to a surrounding of a reinforcing bar by a binding line feed mechanism in a reinforcing bar binder, constituted such that a sleeve is outwardly mounted to a center clamp plate and clamp plates arranged on both left and right sides thereof, the left and right clamp plates are brought into elastic contact with the center clamp plate by respectively interposing springs therebetween, a pair of cam mechanisms by cams and guide pins are provided to the sleeve and the left and right clamp plates and the left and right clamp plates are expanded in accordance with forward movement or rearward movement of the sleeve, and constituted such that the feeding line is fed out by passing through an interval between the center clamp plate and one of the clamp plates by a binding line feed mechanism, a front end of the binding line formed in the loop shape is introduced between the center clamp plate and other of the clamp plates and thereafter, the left and right clamp plates are closed to grasp the binding line.

Further, with regard to the second object, the invention proposes a reinforcing bar binder which is an electric type reinforcing bar binder including a binding line feed mechanism for feeding out a binding line in a loop shape to be wound around a reinforcing bar and a binding line twist mechanism for grasping the binding line wound around the reinforcing bar by grasping means of a hook or the like and twisting the binding line by driving to rotate the grasping means to bind the reinforcing bar, constituted such that the grasping means is constituted by a center clamp plate and an opening and closing type clamp plates arranged on both left and right sides thereof, the binding line fed out by the binding line feed mechanism is made to pass through an interval between the center clamp plate and either one of the left and right clamp plates, a front end of the loop of the binding line fed out thereby is introduced into an interval between the center clamp plate and other of the clamp plates and thereafter, the left and right clamp plates are closed to grasp the loop of the binding line.

Further, there is provided the reinforcing bar binder constituted such that after grasping the front end of the loop of the binding line by closing the clamp plate on a side of grasping the front end of the loop of the binding line, the binding line is pulled back by reversely driving to rotate the binding line feed mechanism and a length of the loop of the binding line is adjusted in accordance with a diameter of the reinforcing bar.

Further, there is provided the reinforcing bar binder, wherein the left and right clamp plates are formed with inclined face portions or projected portion brought into contact with an upper end face or a lower end face of the center clamp plate in clamping the binding line to thereby bend to deform the binding line in clamping the binding line.

Further, with regard to the first object, the invention provides a binding line clamp apparatus of a reinforcing bar binder which is a binding line grasp mechanism for grasping and twisting a loop of a binding line fed out to a surrounding of a reinforcing bar by a binding line feed mechanism in a reinforcing bar binder, constituted such that a sleeve is outwardly mounted to a center clamp plate and clamp plates arranged on both left and right sides thereof, the left and right clamp plates and the sleeve are connected by a pair of left and right cam mechanisms by groove cams and guide pins, the left and right clamp plates are formed to open and close in cooperation with frontward movement and rearward movement of the sleeve, the binding line is fed out to a guide groove formed at a nose by passing through an interval between the center clamp plate and one of the clamp plates by the binding line feed mechanism, a front end of the loop of the binding line is introduced between the center clamp plate and other of the clamp plates and thereafter, the left and right clamp plates are closed to grasp the binding line.

Further, there is provided the binding line clamp apparatus of a reinforcing bar binder constituted such that phases of the pair of left and right groove cams formed at the left and right clamp plates or the sleeve are shifted from each other and after one of the clamp plates grasps a front end of the loop of the binding line, other of the clamp plates grasps a rear end of the loop of the binding line.

Further, with regard to the first object, the invention provides a binding line clamp apparatus of a reinforcing bar binder which is a binding line grasp mechanism for grasping and twisting a loop of a binding line fed out to a surrounding of a reinforcing bar by a binding line feed mechanism in a reinforcing bar binder, constituted such that a sleeve is outwardly mounted to a center clamp plate and clamp plates arranged on both left and right sides thereof, the left and right clamp plates and the sleeve are connected by a pair of left and right cam mechanisms by groove cams and guide pins, the left and right clamp plates are formed to open and close in cooperation with frontward movement and rearward movement of the sleeve, the binding line is fed out to a guide groove of a circular arc shape nose by passing through an interval between the center clamp plate and either one of the left and right clamp plates by the binding line feed mechanism, a front end of a loop of the binding line is introduced between the center clamp plate and other of the clamp plates and thereafter, the left and right clamp plates are closed to grasp the binding line, and constituted such that an upper portion of a face of grasping the binding line of the right clamp plate or the left clamp plate grasping the front end of the binding line is formed with a stopper portion projected in a center direction and the front end of the binding line impinges on the stopper portion to stop.

Further, there is provided the binding line clamp apparatus of a reinforcing bar binder, wherein the face of grasping the binding line of the clamp plate on a side of feeding out the binding line is provided with a guide groove for feeding out the binding line.

Further, with regard to the third object, the invention provides a reinforcing bar binder which is a reinforcing bar binder including a binding line feed mechanism for feeding out a binding line along a guide groove at an inner periphery of a nose to wind around the reinforcing bar, a binding line grasp mechanism for grasping the binding line wound around the reinforcing bar, and a binding line twist mechanism for twisting the binding line to bind the reinforcing bar by driving to rotate the binding line grasp mechanism, wherein a guide plate for being brought into contact with the binding lie fed along the guide grove by the binding line feed mechanism to curl is provided and the guide plate is formed movably to a position opposed to the guide groove and a position separated from the guide groove.

Further, there is provided the reinforcing bar binder characterized in being constituted such that the guide plate is made to be opposed to the guide groove and the binding line brought into contact with the guide plate is curled in a step of feeding out the binding line, the guide plate is escaped to the position separated from the guide groove after the step of feeding out the binding line and the binding line is pulled back by reversely driving to rotate the binding line feed mechanism and a length of the binding line is controlled in accordance with a diameter of the reinforcing bar.

Figure 1:
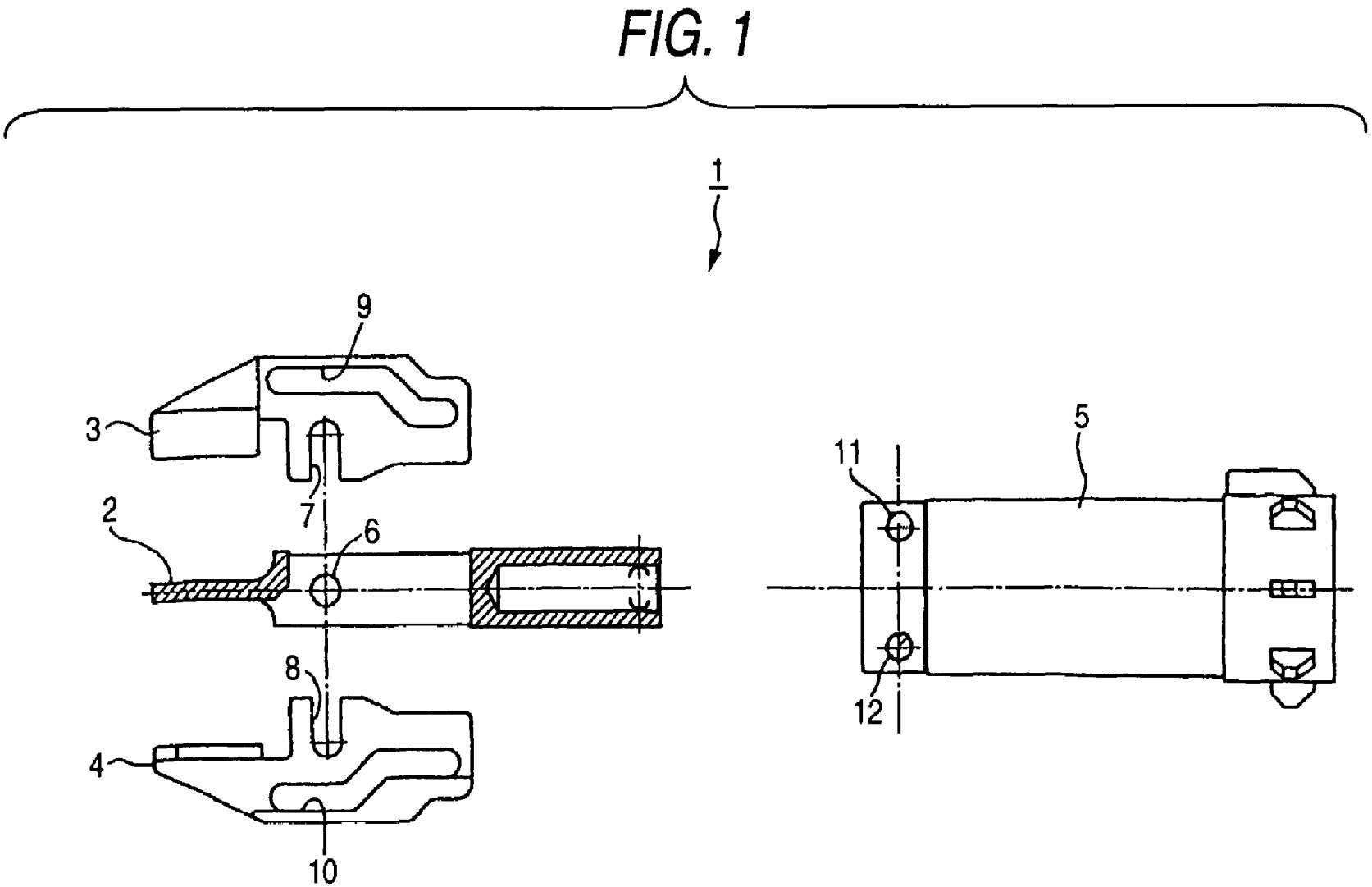
FIG. 1 is a disassembled plane view of a binding line clamp apparatus of a reinforcing bar binder showing an embodiment of the invention.

Note that in the drawings, numeral 1 designates a binding line clamp apparatus, numeral 2 designates a center clamp plate, numeral 3 designates a right clamp plate, numeral 4 designates a left clamp plate, numeral 5 designates a sleeve, numerals 9, 10 designate groove cams, numerals 11, 12 designate guide pins, numeral 13 designates a ball screw shaft, numeral 14 designates a stopper portion, numeral 18 designates a shifter plate, numeral 19 designates a binding line cut apparatus, numeral 20 designates a binding line guide apparatus, numeral 501 designates a binding line twist mechanism, numeral 502 designates a binding line feed mechanism, numeral 506 designates a circular arc shape nose, numeral 507 designates a twist motor, numeral 508 designates a slide motor, numeral 511 designates a ball screw shaft, numeral 513 designates a binding line clamp apparatus, numeral 514 designates a center clamp plate, numeral 5115 designates a right clamp plate, numeral 516 designates a left clamp plate, numeral 517 designates a sleeve, numeral 523 designates a binding line guide groove, numeral 524 designates a recess, numerals 525, 526 designate guide pins, numerals 527, 528 designate cams, numerals 531, 532 designate pushers, numeral 533 designates a compression coil spring, numeral 701 designates a binding line guide apparatus, numeral 702 designates a binding line cut apparatus, numeral 703 designates a binding line clamp apparatus, numeral 707 designates a sleeve, numeral 709 designates a shifter plate, numeral 710 designates guide plate cam, numeral 711 designates a slide cam plate, numeral 712 designates a shaft (guide plate), numeral 713 designates a support frame, numeral 714 designates a nose, numeral 715 designates a guide groove (nose), numeral 716 designates a forming portion (guide plate), numeral 717 designates a long hole (slide cam plate) and numeral 718 designates a compression coil spring.

BEST MODE FOR CARRYING OUT THE INVENTION

Figure 2:
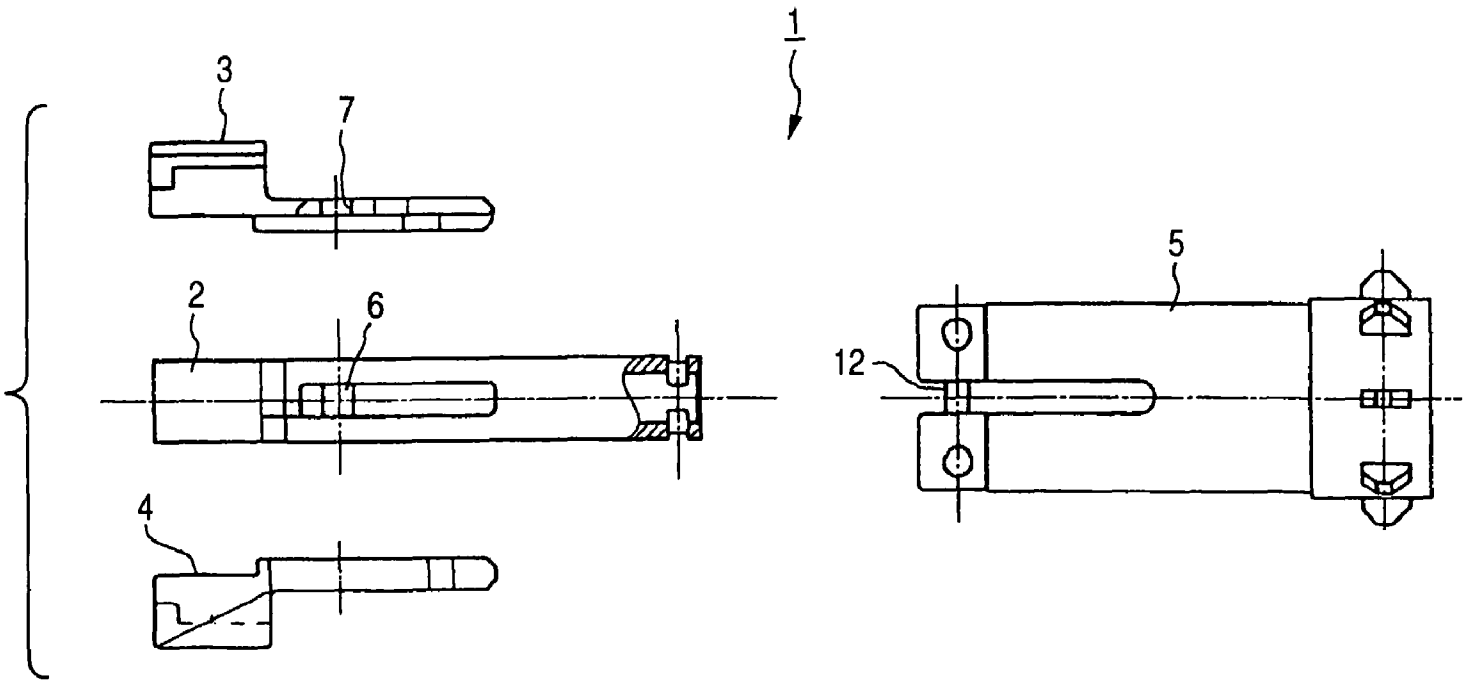
FIG. 2 is a disassembled side view of the bind line clamp apparatus.
Figure 3:
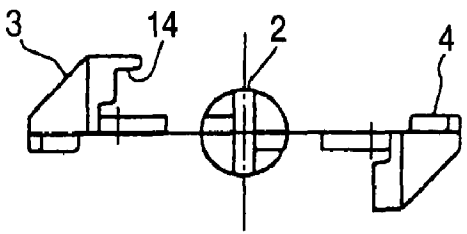
FIG. 3 is a front view of the three pieces of clamp plates.

A detailed description will be given of an embodiment of the invention in reference to the drawings as follows. FIG. 1 through FIG. 3 show constituent members of the binding line clamp apparatus 1 of a reinforcing bar binder, numeral 2 designates the center clamp plate, numeral 3 designates the right clamp plate, numeral 4 designates the left clamp plate and numeral 5 designates the sleeve outwardly fitted to a shaft portion of the center clamp plate.

A middle of the center clamp plate 2 is provided with a guide pin 6 in a longitudinal direction and the left and right clamp plates 3, 4 are openably and closably integrated to the center clamp plate 2 by engaging slide guide grooves 7, 8 formed at inner side faces of the left and right clamp plates 3, 4 to the guide pin 6. The left and right clamp plates 3, 4 are formed with grooves cams 9, 10 and the groove cams 9, 10 are engaged with the guide pins 11, 12 of the sleeve 5. The grooves cams 9, 10 are formed in a step-like shape moving front portions thereof to outer sides relative to rear portions thereof in parallel therewith and there is constituted a structure in which when the sleeve 5 is moved forward relative to three pieces of the clamp plates 2, 3, 4, the left and right clamp plates 3, 4 are moved in directions approaching each other to thereby pinch the center clamp plate 2. Phases of the groove cams 9, 10 of the left and right cam plates are shifted from each other, when the sleeve is moved forward, first, the right clamp plate 3 (upper side in the drawing) is brought into contact with the center clamp plate 2 and thereafter, the left clamp plate 4 is brought into contact with the center clamp plate 2.

Figure 4A:
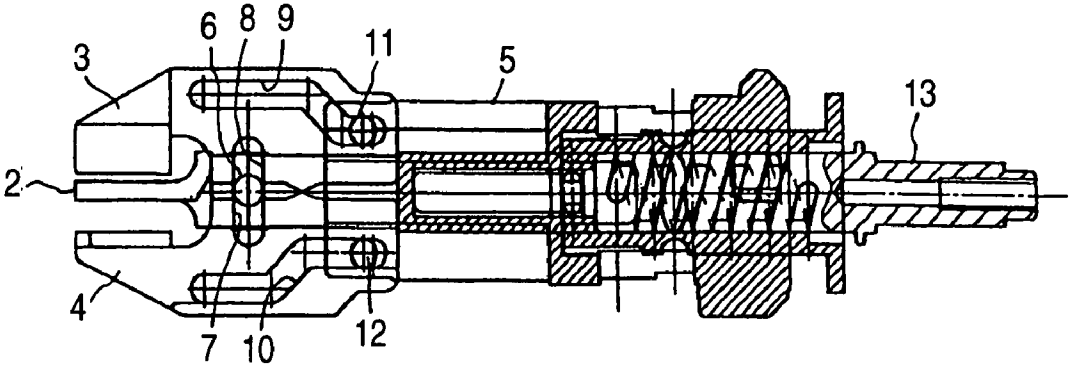
FIG. 4(*a*) through FIG. 4(*c*) show an initial state of the binding line clamp apparatus, FIG. 4(*a*) is a plane sectional view, FIG. 4(*b*) is a front sectional view and FIG. 4(*c*) is a side sectional view.
Figure 4C:
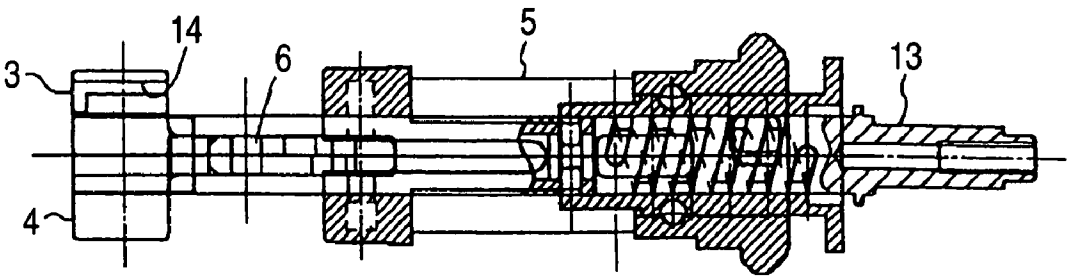
Figure 4B:
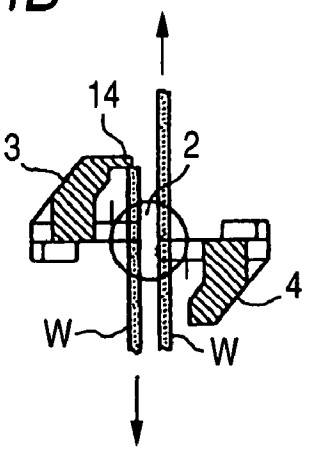

FIG. 4 illustrates a state of integrating three pieces of the clamp plates 2, 3, 4 and the sleeve 5 and the ball screw shaft 13, the shaft portion of the center clamp plate 2 is rotatably connected to the ball screw shaft 13 and a ball (not illustrated) attached to an inner peripheral face of the sleeve 5 is brought in mesh with the ball screw shaft 13. As shown by FIG. 4(*b*), a portion of an inner side face of the right clamp plate 3 (left one in FIG. 4(*b*)) above a middle portion in an up and down direction is constituted by an inclined face approaching in a center direction and is formed with the stopper portion 14 projected from an upper end of the inclined face horizontally in the center direction. Further, symmetrically, a portion of an inner side face of the left clamp plate 4 (right one in FIG. 4(*b*)) is constituted by an inclined face approaching in the center direction.

Figure 5A:
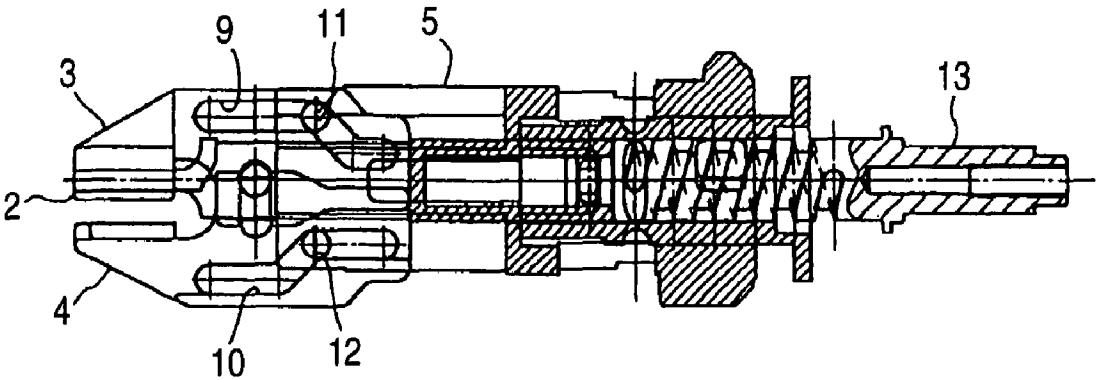
FIG. 5(*a*) through FIG. 5(*c*) show a step of grasping a front end of a binding line of the binding line clamp apparatus, FIG. 5(*a*) is a plane sectional view, FIG. 5(*b*) is a front sectional view and FIG. 5(*c*) is a side sectional view.
Figure 5C:
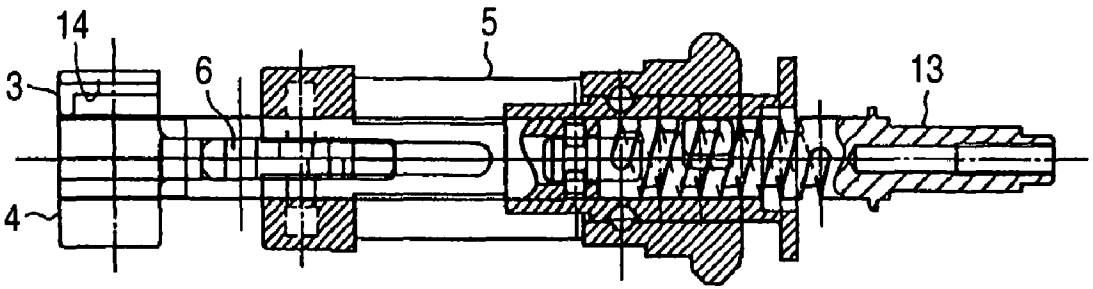
Figure 5B:
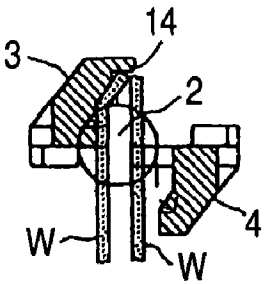
Figure 6A:
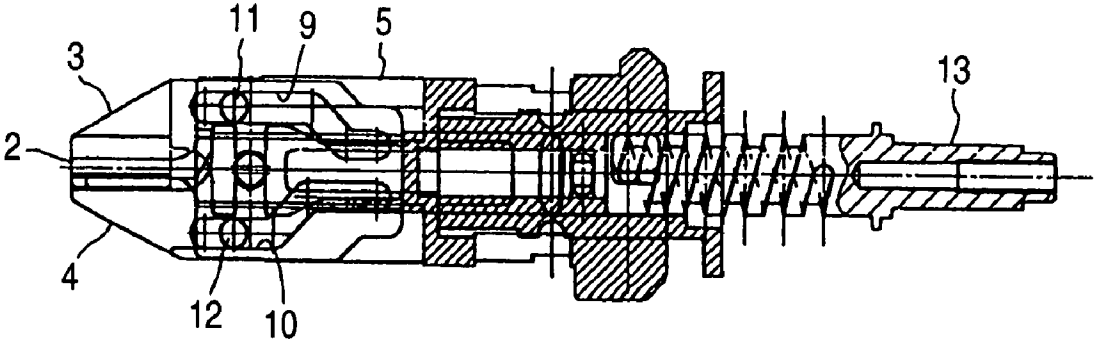
FIG. 6(*a*) through FIG. 6(*c*) show a step of grasping a rear end of the binding line of the binding line clamp apparatus, FIG. 6(*a*) is a plane sectional view, FIG. 6(*b*) is a front sectional view and FIG. 6(*c*) is a side sectional view.
Figure 6C:
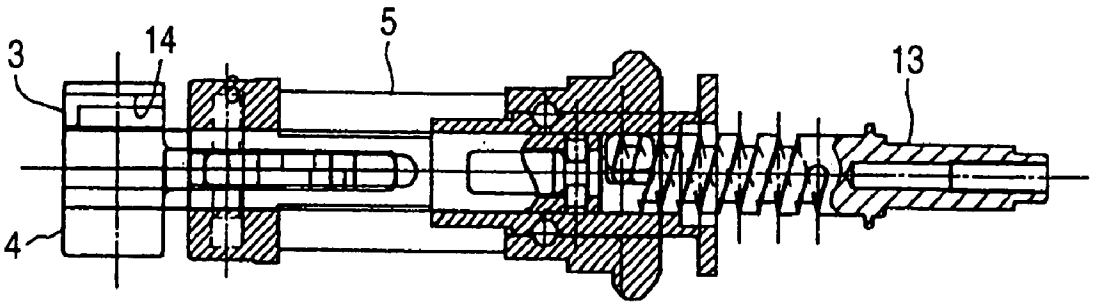
Figure 6B:
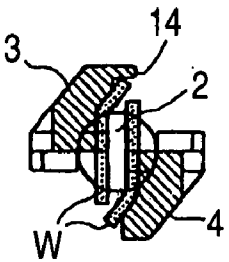

In staring the reinforcing bar binder, a wire is fed out from a lower side through an interval between the left clamp plate 4 and the center clamp plate 2 by a binding line feed apparatus (not illustrated) and a front end of the wire W fed along a circular arc shape nose (not illustrated) and formed in a loop-like shape moves forward from a lower side into an interval between the right clamp plate 3 and the center clamp plate 2 and impinges on the stopper portion 14 of the right clamp plate 3 to stop as shown by FIG. 4(*b*). Successively, a twist motor (not illustrated) is started to move forward the sleeve 5 by rotating the ball screw shaft 13 in the clockwise direction in view from a side of the motor. Thereby, as shown by FIG. 5(*b*), the right clamp plate 3 is slid to the center direction to clamp the wire W and bends the front end of the wire W to the center direction by the upper inclined face. Further, when the sleeve moves further forward as shown by FIG. 6, the left clamp plate 4 is slid in the center direction to clamp the wire W as shown by FIG. 6(*b*) and simultaneously bends a rear end of the wire loop in the center direction to enter a successive twisting step.

Figure 7A:
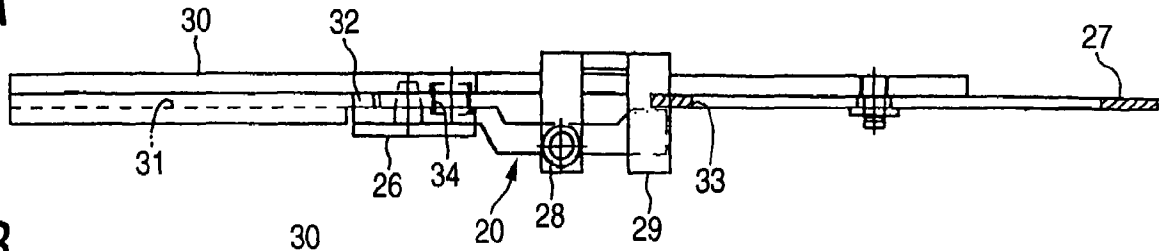
FIG. 7(*a*) and FIG. 7(*b*) show a step of feeding the binding line of the reinforcing bar binder, FIG. 7(*a*) is a plane view of a binding line guide apparatus and FIG. 7(*b*) is a side view of the reinforcing bar binder.
Figure 7B:
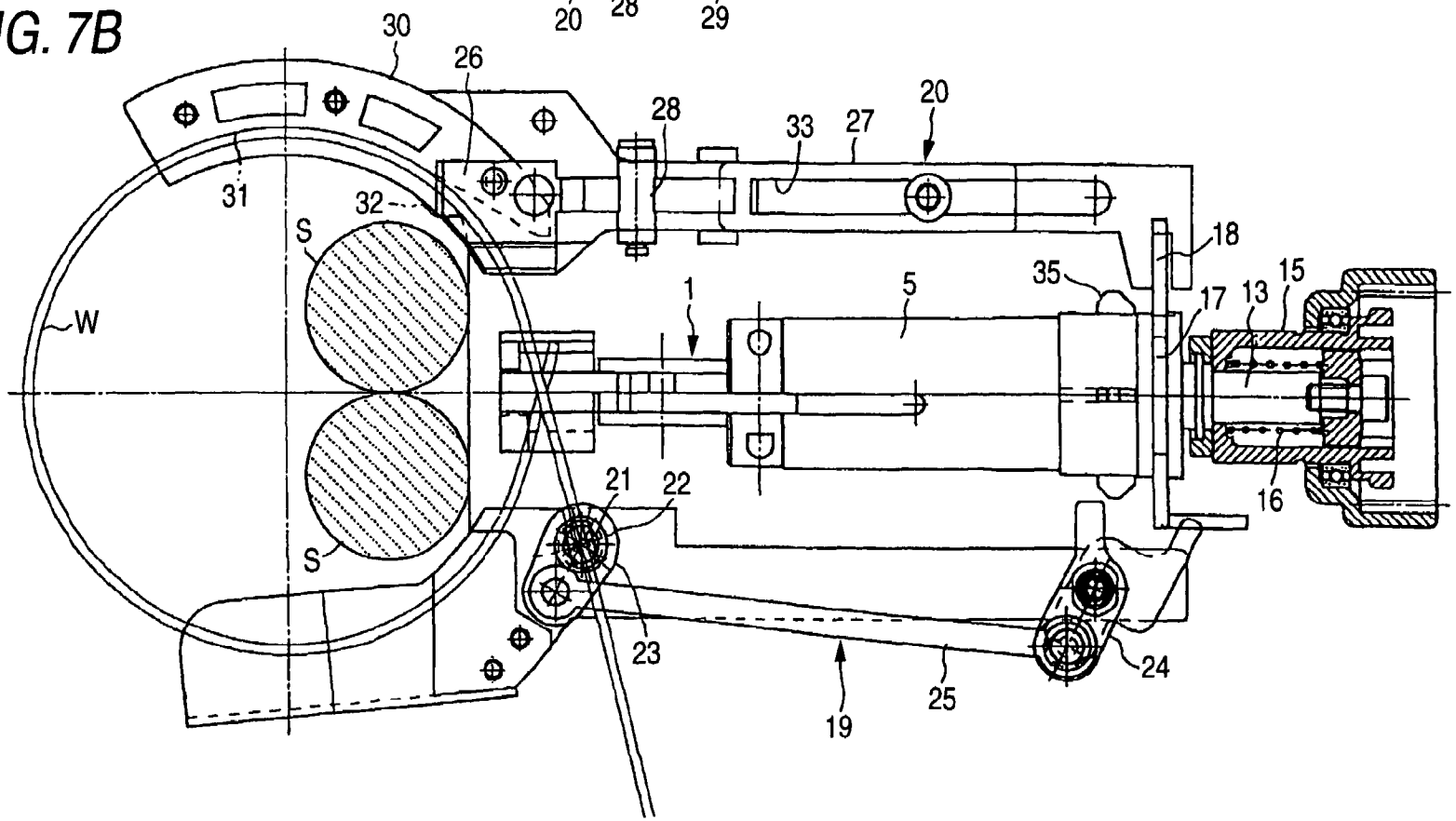

FIG. 7 shows a binding mechanism portion of the reinforcing bar binder and the ball screw shaft 13 is coupled with a hollow drive shaft 15 by a spline and is pushed down to a rear position by a compression coil spring 16 inserted to inside of the drive shaft 15. The drive shaft 15 is driven to rotate by way of a twist motor and a reduction gear mechanism (not illustrated). A groove 17 in a peripheral direction formed at a rear end portion of the sleeve 5 is engaged with the shifter plate 18 and the binding line cut apparatus 19 arranged on the lower side and the binding line guide apparatus 20 arranged on the upper side are driven by the shifter plate 18 moving in a front and rear direction along with the sleeve 5.

The binding line cut apparatus 19 is a rotary wire cutter forming a hole traversing an axis center of a pin 21 fixed to a front portion of a frame and forming holes having wide widths at two front and rear faces of a cylindrical sleeve 22 mounted to the pin 21 and a front lever 23 attached with the cylindrical sleeve 22 and a rear lever 24 are connected by a link 25. The binding line cut apparatus 19 is set to an initial state of FIG. 7 by a spring (not illustrated) and at this occasion, the holes of the pin 21 and the cylindrical sleeve 22 coincide with each other and the wire W is fed out through the hole of the pin 21. When the sleeve 5 of the binding line clamp apparatus 1 is moved forward, the rear lever 24 of the binding line cut apparatus 19 is pushed forward by the shifter plate 18 and the cylindrical sleeve 22 at the front portion is rotated in cooperation therewith to cut the wire W at an outlet of the hole of the pin 21.

A binding line guide apparatus 20 is constructed by a constitution of driving a forming plate 26 pivotable in a lateral direction by a slide cam plate 27 and a shaft 28 of the forming plate 26 of a lever type is attached to a support frame 29. An inner peripheral face of the circular arc shape nose 30 is provided with a guide groove 31 in a peripheral direction, a side face of a base portion thereof is partially notched and a front end portion of the forming plate 26 is brought into the notched portion. Further, the guide groove 31 may be constituted by a shape of capable of curling a binding line to guide and the shape can be constituted also by a shape of connecting straight lines in steps or the like and is not limited to the circular arc shape.

Figure 8A:
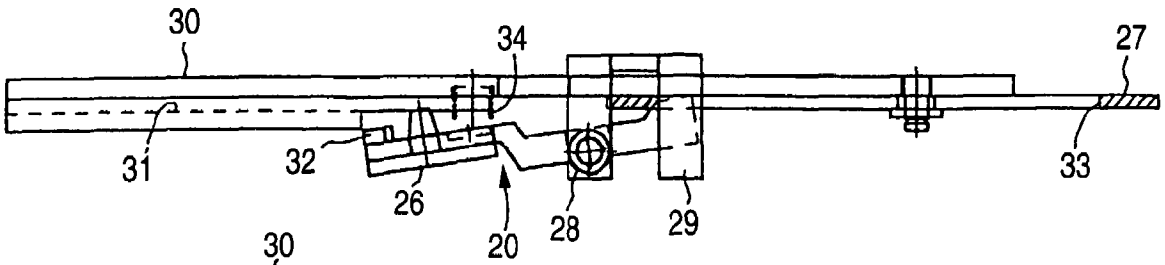
FIG. 8(*a*) and FIG. 8(*b*) show a step of pulling back the binding line of the reinforcing bar binder, FIG. 8(*a*) is a plane view of the binding line guide apparatus and FIG. 8(*b*) is a side view of the reinforcing bar binder.
Figure 8B:
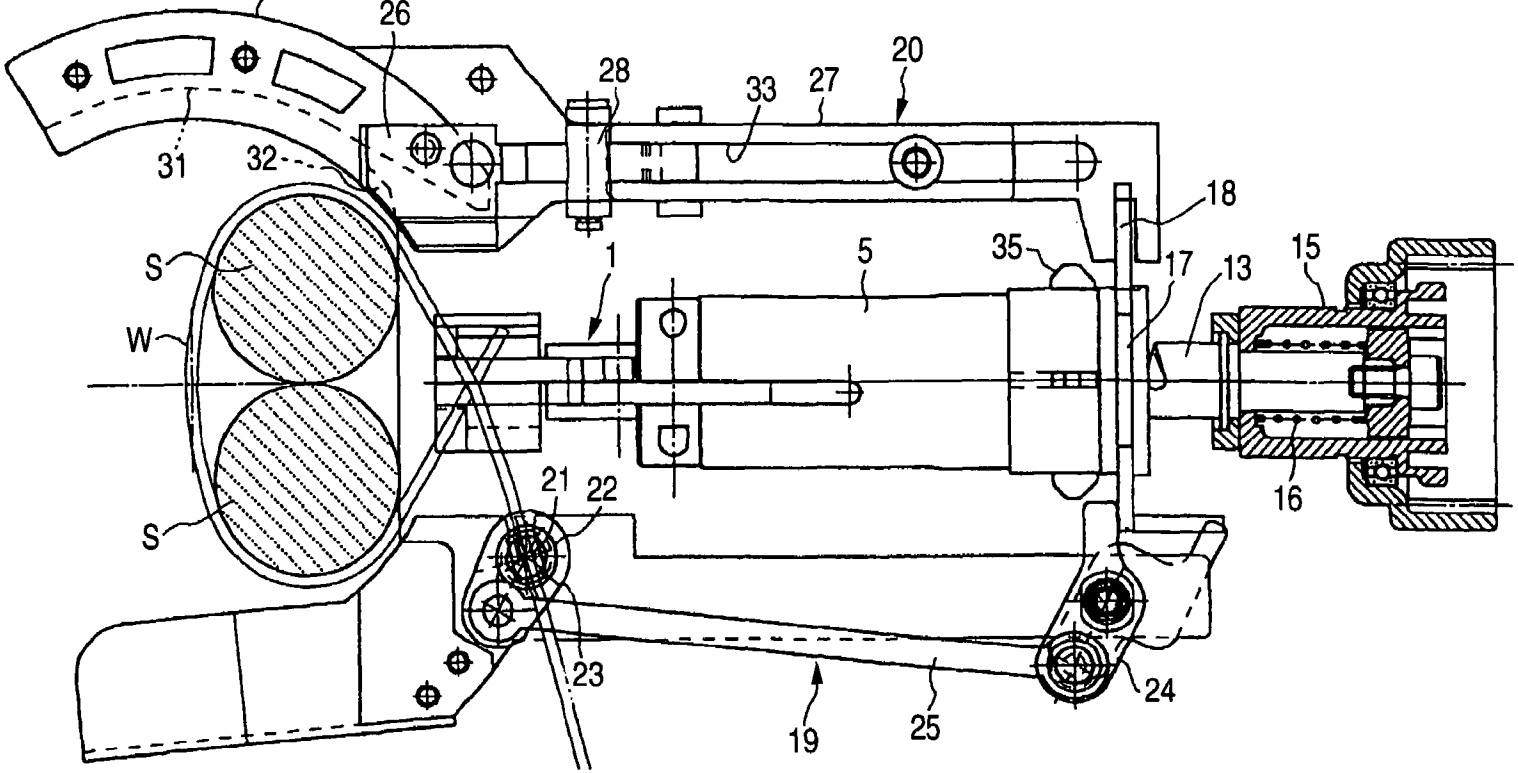

As shown by FIG. 8(*a*), a side face of a front end portion of the forming plate 26 is formed with a guide portion 32, since the guide portion 32 is brought into contact with the notched portion of the circular arc shape nose 30 in the initial state shown in FIG. 7, the wire 7 is passed through an interval between the guide portion 32 and the guide groove 31 of the circular arc shape nose 30 and is fed out along the guide groove 31 and at this occasion, formed in the circular arc shape by the guide portion 32 and the guide groove 31.

A slide cam plate 27 is formed with a long hole 33 in a front and rear direction at a side face thereof and in the initial state, a rear end portion of the forming plate 26 is brought into contact with a plane portion on a front side of the long hole 33. A rear end portion of the slide cam plate 27 is engaged with the shifter plate 18 and the sleeve 5 and the slide cam plate 27 are integrally slid in the front and rear direction. When the slide cam plate 27 is moved forward from an initial position, as shown by FIG. 8(*a*), the rear end portion of the forming plate 26 falls into the long hole 33 of the slide cam plate 27 and the guide portion 32 at the front portion is separated from the circular arc shape nose 30. Further, when the slide cam plate 27 returns to the initial position, the rear end portion of the forming plate 26 comes out from the long hole 33 and the guide portion 32 at the front portion is brought into contact with the notched portion of the circular arc shape nose.

Next, an explanation will be given of operation of the reinforcing bar binder. FIG. 7 shows a state of feeding out the wire W from the initial state by a binding line feed apparatus and forming a wire loop surrounding the surrounding of a reinforcing bar S and as shown by FIG. 4, the front end of the wire W impinges on the stopper portion 14 of the right clamp plate 3 to stop.

Successively, the ball screw shaft 13 is driven to rotate regularly, as shown by FIG. 8, the sleeve 5 of the binding line clamp apparatus 1 is moved forward and as shown by FIG. 5, the right clamp plate 3 is closed to clamp the front end of the wire W. Simultaneously therewith, the forming plate 26 of the binding line guide apparatus 20 is opened, the binding line feed apparatus is driven to rotate reversely and the wire W is pulled back to be wound around the reinforcing bar S.

Figures 9A, 9B:
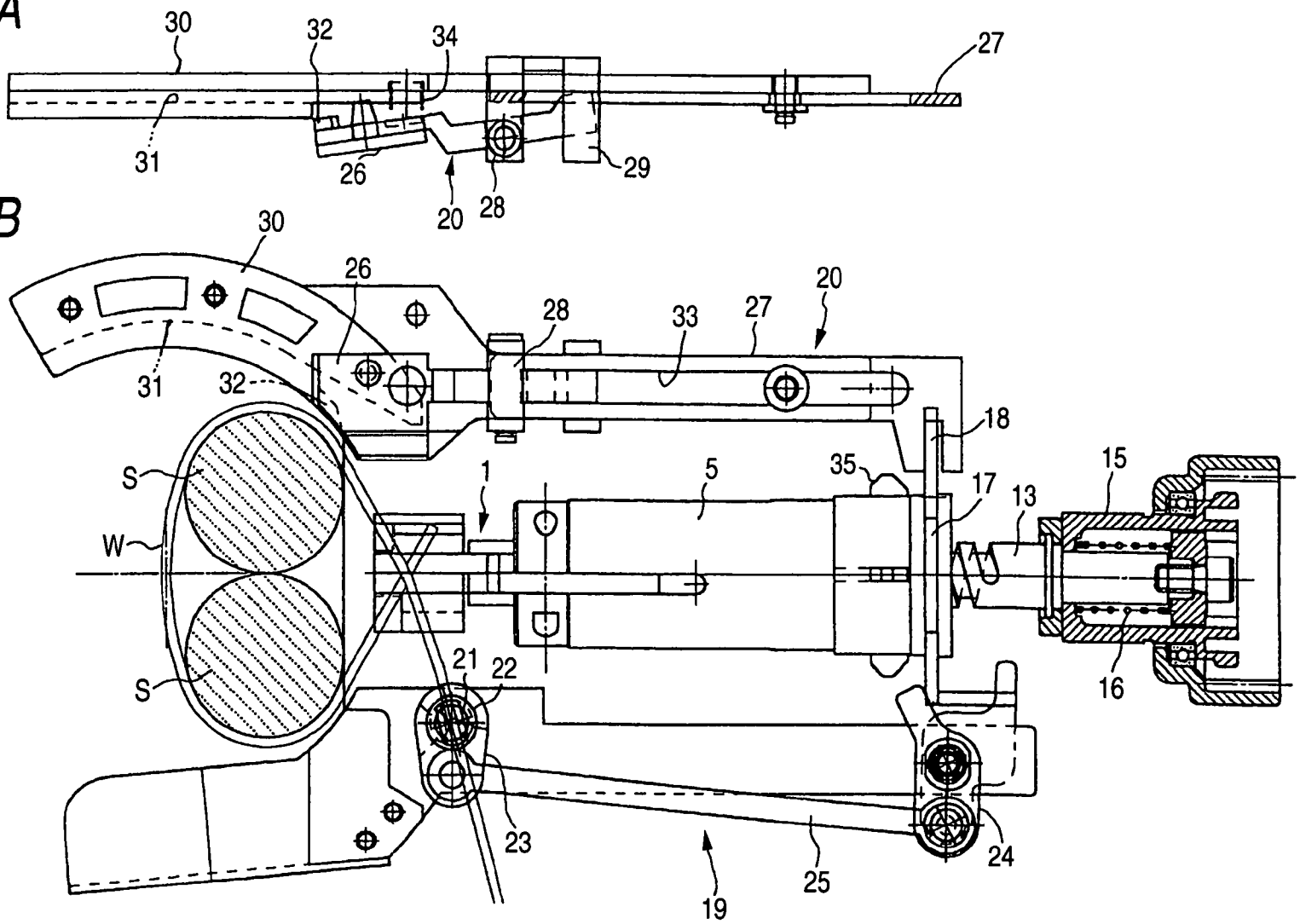
FIG. 9(*a*) and FIG. 9(*b*) show a step of grasping the rear end of the binding line of the reinforcing bar binder, FIG. 9(*a*) is a plane view of the binding line guide apparatus and FIG. 9(*b*) is the side view of the reinforcing bar binder.
Figures 10A, 10B:
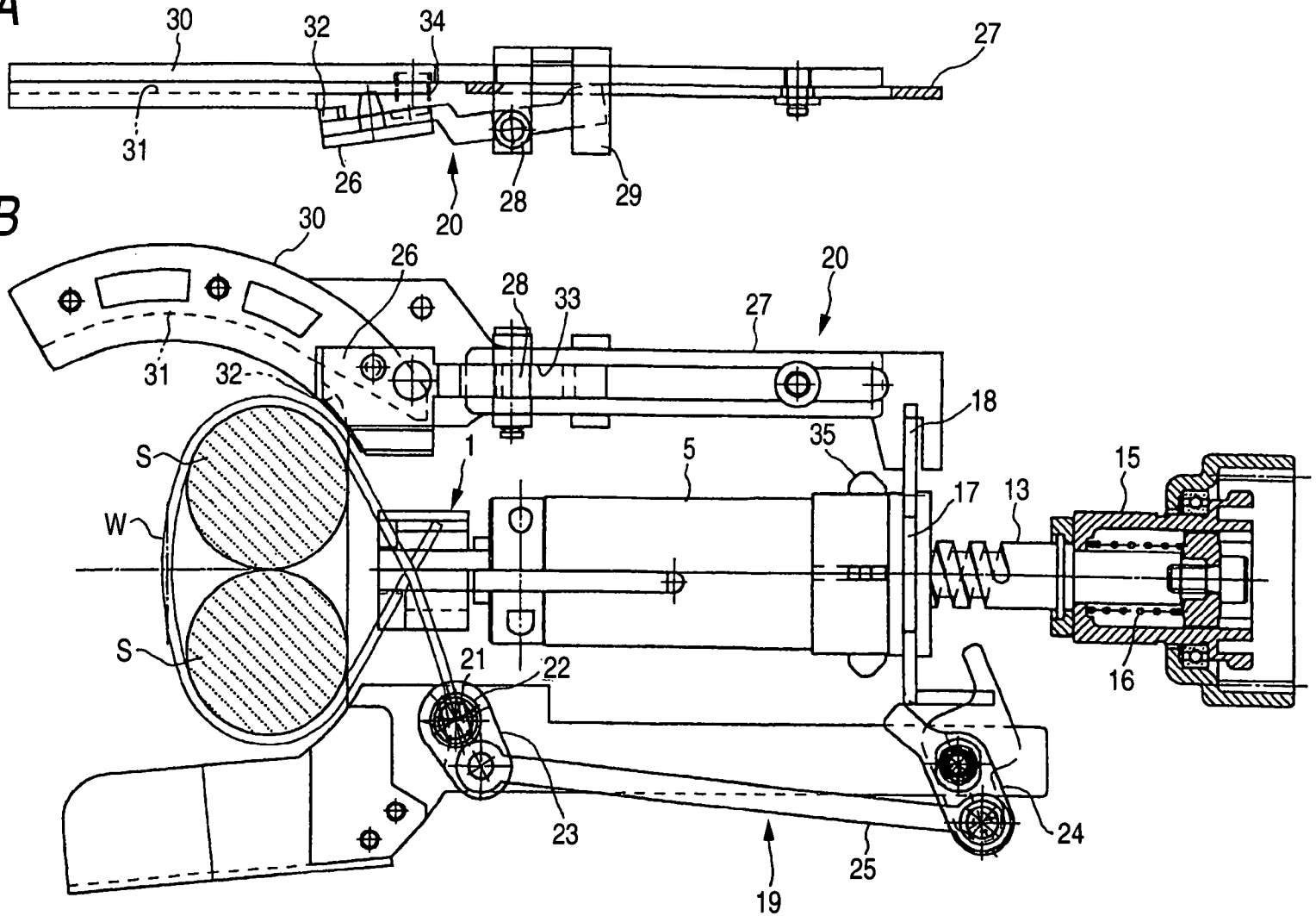
FIG. 10(*a*) and FIG. 10(*b*) show a step of cutting the binding line of the reinforcing bar binder, FIG. 10(*a*) is a plane view of the binding line guide apparatus and FIG. 10(*b*) is a side view of the reinforcing bar binder.

Further, as shown by FIG. 9 and FIG. 6, the left clamp plate 4 is closed to clamp the rear end of the wire loop, as shown by FIG. 10, the sleeve 5 is moved further forward to push the rear lever 24 of the binding line cut apparatus 19 and the cylindrical sleeve 22 at the front portion is rotated to cut the wire W. Further, by moving forward the sleeve 5, a rotation stopping fin 35 provided at the rear end of the sleeve 5 is detached from a stopper (not illustrated) of the frame and a total of the binding line clamp apparatus is started to rotate to twist the wire W. At this occasion, tension of the wire W is increased in accordance with progress of twisting and the wire W is slid among the clamp plates by constituting fulcra by end portions thereof bent by the left and right clamp plates 3, 4 and is twisted in the form of being extracted from the center of the front face of the binding line clamp apparatus 1 in the up and down direction.

Figure 11A:
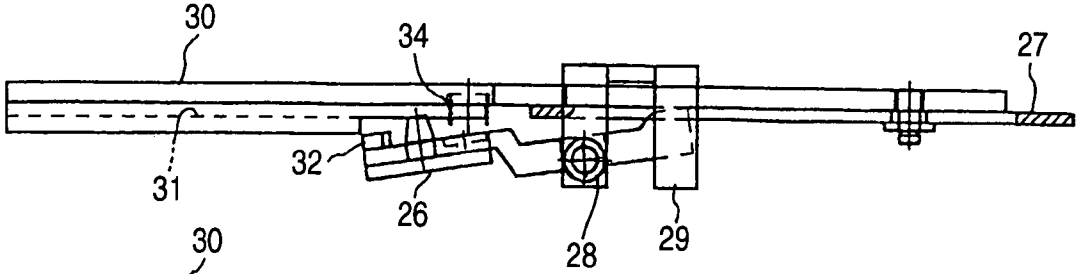
FIG. 11(*a*) and FIG. 11(*b*) show a step of twisting the binding line of the reinforcing bar binder, FIG. 11(*a*) is a plane view of the binding line guide apparatus and FIG. 11(*b*) is a side view of the reinforcing bar binder.
Figure 11B:
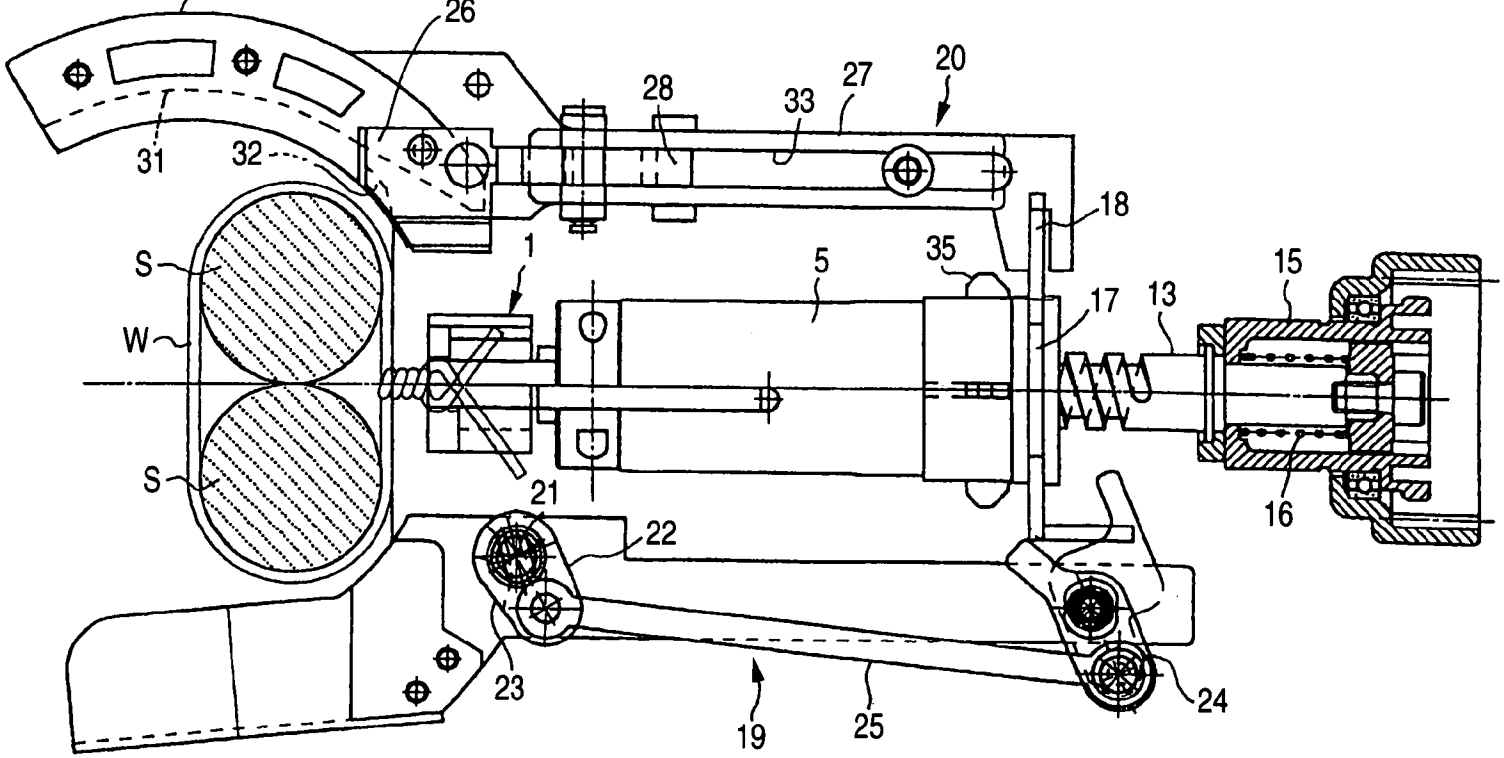
Figure 12A:
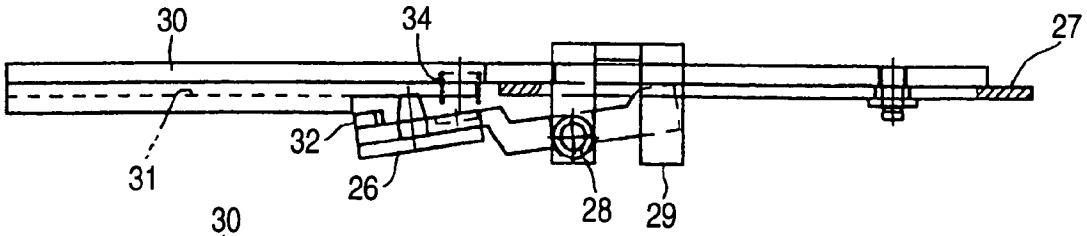
FIG. 12(*a*) and FIG. 12(*b*) show a step of twisting the binding line of the reinforcing bar binder, FIG. 12(*a*) is a plane view of the binding guide apparatus and FIG. 12(*b*) is a side view of the reinforcing bar binder.
Figure 12B:
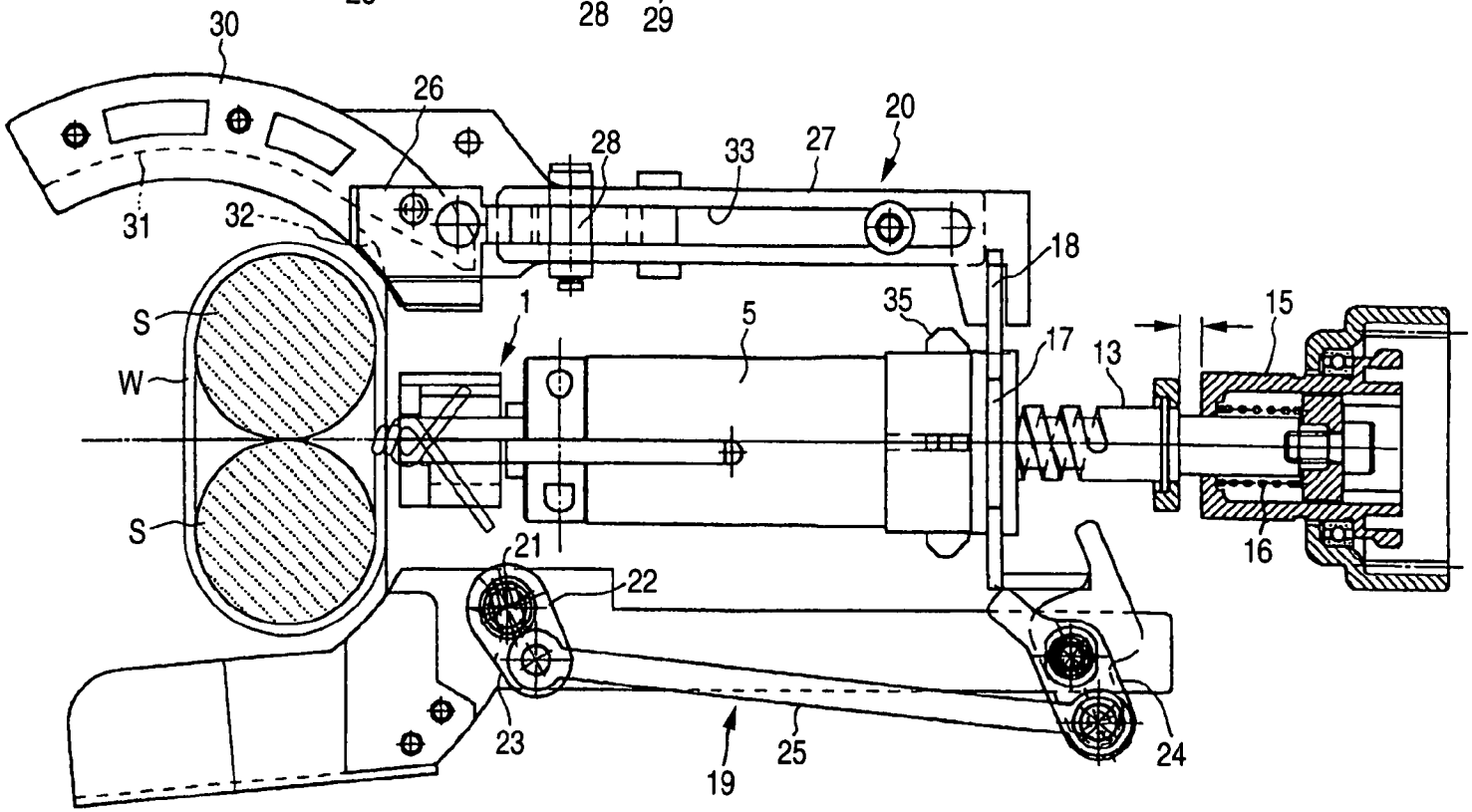

FIG. 11 shows a state of finishing to twist and the twist motor is stopped to drive by detecting an increase in a load of rotating the twist motor by a current detecting circuit. Although a length of a twist margin of the wire W is varied depending on a diameter of the reinforcing bar, when the twist margin is short, as shown by FIG. 12, the ball screw shaft 13 and the binding line clamp apparatus 1 are moved forward by compressing the compression coil spring 16 at inside of the drive shaft 15 and the wire is prevented from being cut by limiting the tension in accordance with the length of the wire.

Figure 13A:
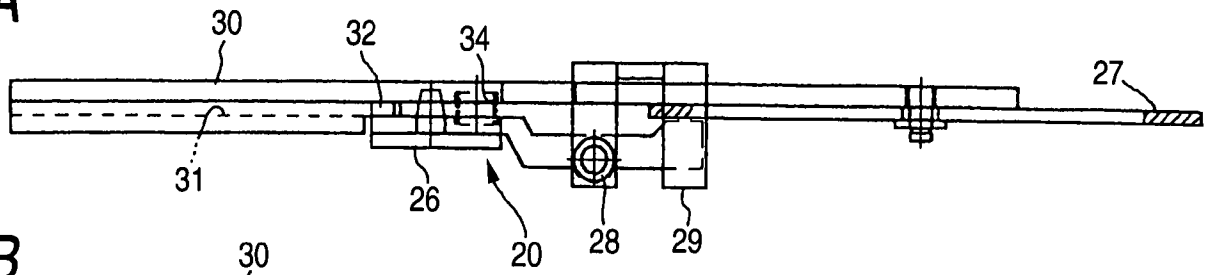
FIG. 13(*a*) and FIG. 13(*b*) show a step of releasing the binding line of the reinforcing bar binder, FIG. 13(*a*) is a plane view of the binding line guide apparatus and FIG. 13(*b*) is a side view of the reinforcing bar binder.
Figure 13B:
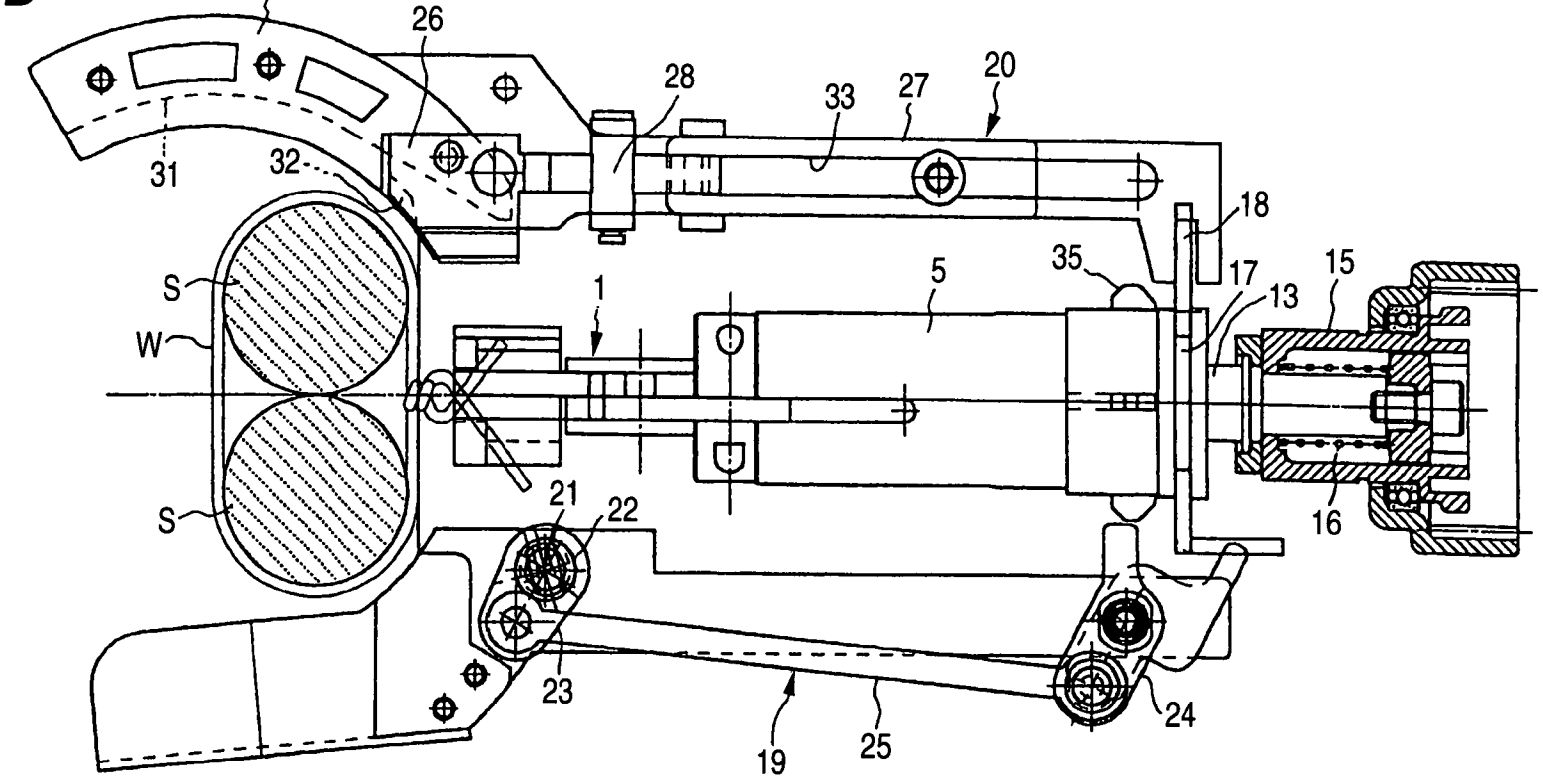
Figure 14:
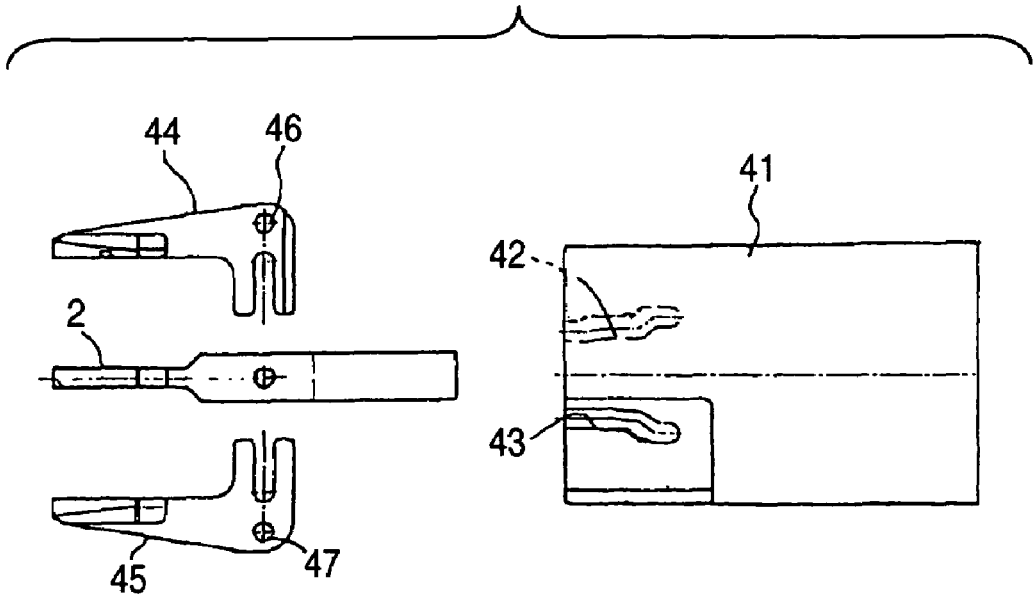
FIG. 14 is a disassembled plane view showing other embodiment of a binding line clamp apparatus.
Figure 15:
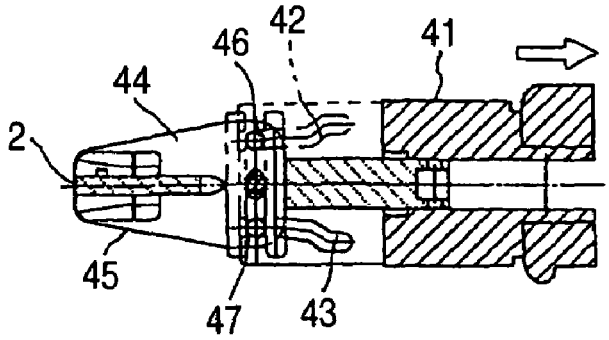
FIG. 15 is a plane sectional view showing the other embodiment of the binding line clamp apparatus.
Figure 16:
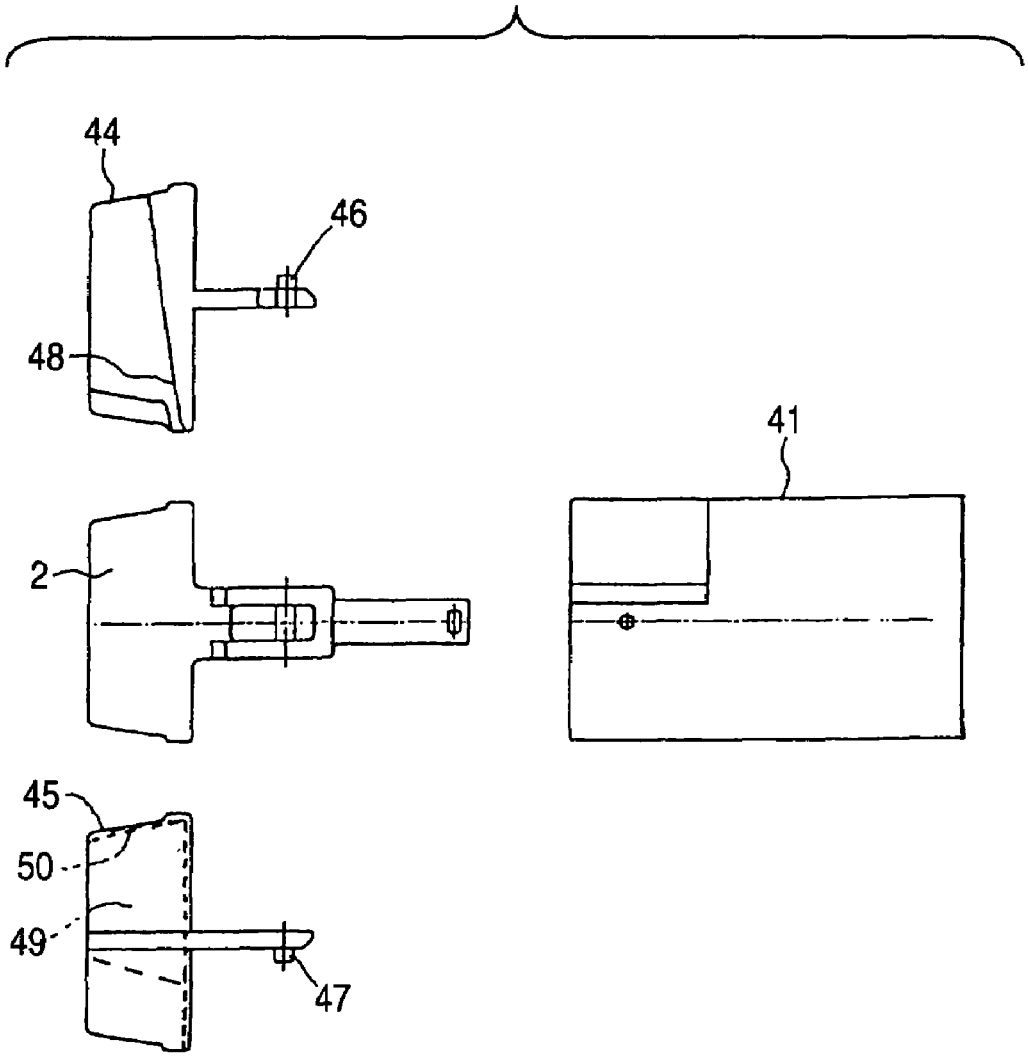
FIG. 16 is a side view of constituent parts of the binding line clamp apparatus of FIG. 14.

Further, after finishing to twist, the twist motor is driven to rotate reversely, as shown by FIG. 13, the binding line clamp apparatus 1 returns to the initial position, the left and right clamp plates 3, 4 are opened to release the wire W and also the binding line cut apparatus 19 and the binding guide apparatus 20 return to the initial state. Further, although an explanation has been given by taking an example of the wire as the biding line, a wire other than the metal wire may be used.

FIG. 14 through FIG. 17 show other embodiment of the binding line clamp apparatus and contrary to the above-described binding line clamp apparatus 1, groove cams 42, 43 are formed at a sleeve 41, guide pins 46, 47 are provided at left and right clamp plates 44, 45 and the left and right clamp plates 44, 45 are constituted to close when the sleeve 41 is moved rearward. Further, also in FIG. 17, the left and right clamp plates 44, 45 are constituted to close when the sleeve 41 is moved rearward from a front initial position. In any embodiment, the operation stays the same as that of the prior binding line clamp apparatus.

An inner side face of the right clamp plate 44 is formed with a binding line guide groove 48 constituting a path of feeding out the binding line and an inner side face of the left cam plate 45 is formed with a recess 49 (recess portion) reaching a vicinity of an upper end thereof from a lower end thereof. The binding line is fed in a state of slightly opening and left and right clamp plates 44, 45, the binding line is fed out to the circular arc shape nose 6 of the reinforcing bar binder by passing the binding line guide groove 48 of the right clamp plate 44 and the front end of the binding line moves forward from the lower side into the recess 49 of the left cam plate 45 and impinges on a ceiling face 50 (stopper portion) at the upper end of the recess 49 to stop.

Figure 17:
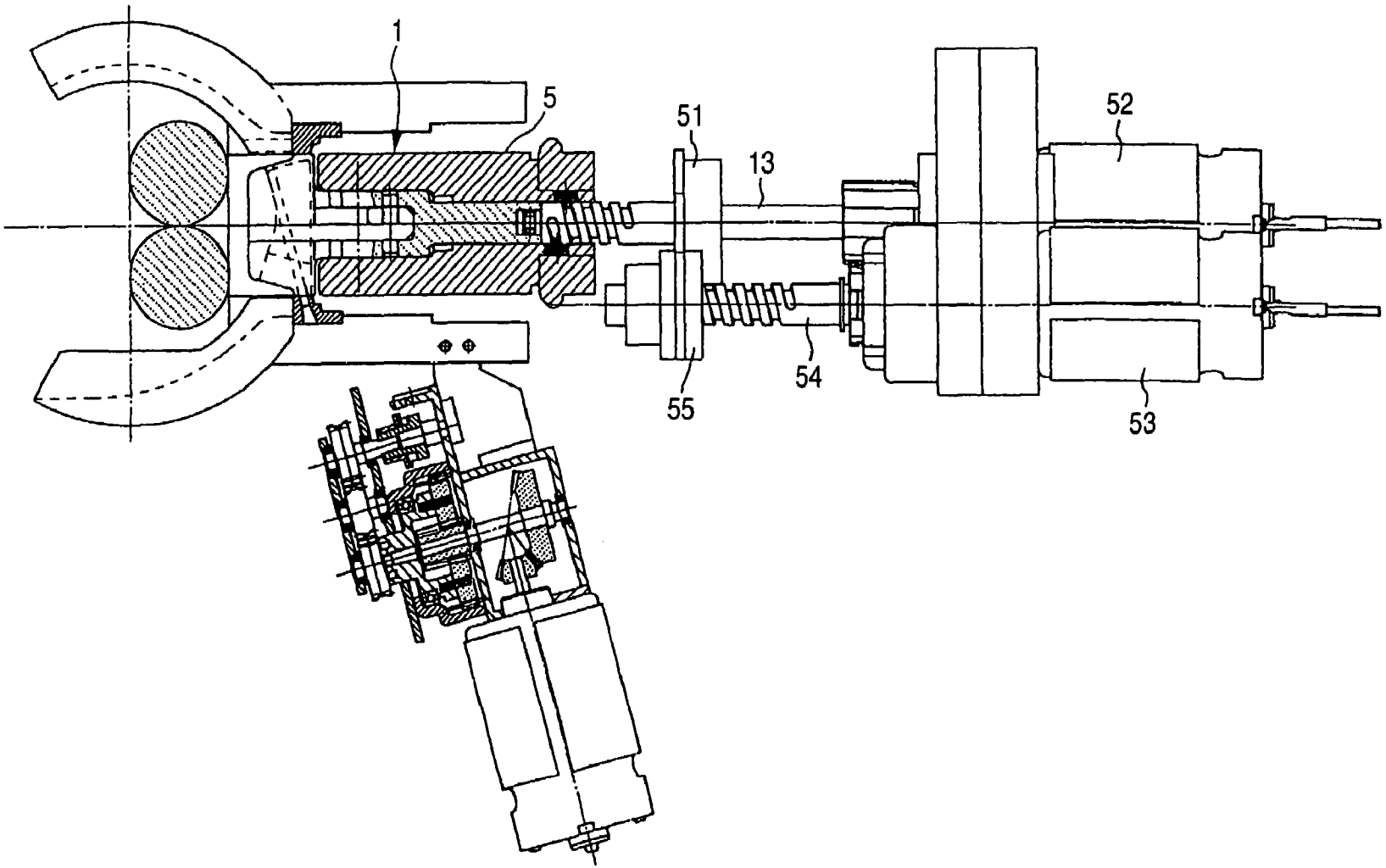
FIG. 17 is a plane sectional view of the binding line clamp apparatus of FIG. 14.

Further, FIG. 17 shows other embodiment of the slide mechanism for moving the binding line clamp apparatus 1 in the front and rear direction and a middle portion of the ball screw shaft 13 is attached with a shifter disk 51 rotatable relative to the ball screw shaft 13. A ball screw shaft 54 of a slide motor 53 arranged in parallel with a twist motor 52 is fitted with a ball holding ring 52 and the ball holding ring 55 is coupled with the shifter disk 51. Therefore, the ball screw shaft 13 of the binding line twist mechanism and the binding line clamp apparatus 1 are moved in the front and rear direction in accordance with a direction of rotating the slide motor 53 and similar to the embodiment explained above, after grasping the binding line, the binding line clamp apparatus 1 is moved rearward from the front initial position to cut the wire and to apply tension to the wire loop. Further, when a drive current reaches a prescribed upper limit value by increasing the load of driving the slide motor 53, the slide motor 53 is stopped to enter a twisting step. Further, although illustration is omitted, there may be constructed a constitution of mounting position detecting means of an optical type position detecting sensor or the like by a photointerrupter and a slit plate to the shifter disk 51 or the ball holding ring 55 or the like on the side of the slide motor 53 or the like and controlling to drive the slide motor 53 by detecting a position of the binding line clamp apparatus 1 in the front and rear direction by the position detecting means.

Further, the invention is not limited to the above-described embodiments and although an explanation has been given by taking an example of the wire as the binding line, a wire other than the metal wire may be used. Further, the invention can variously be modified within the technical range of the invention and the invention naturally covers modified embodiments thereof.

Figure 18:
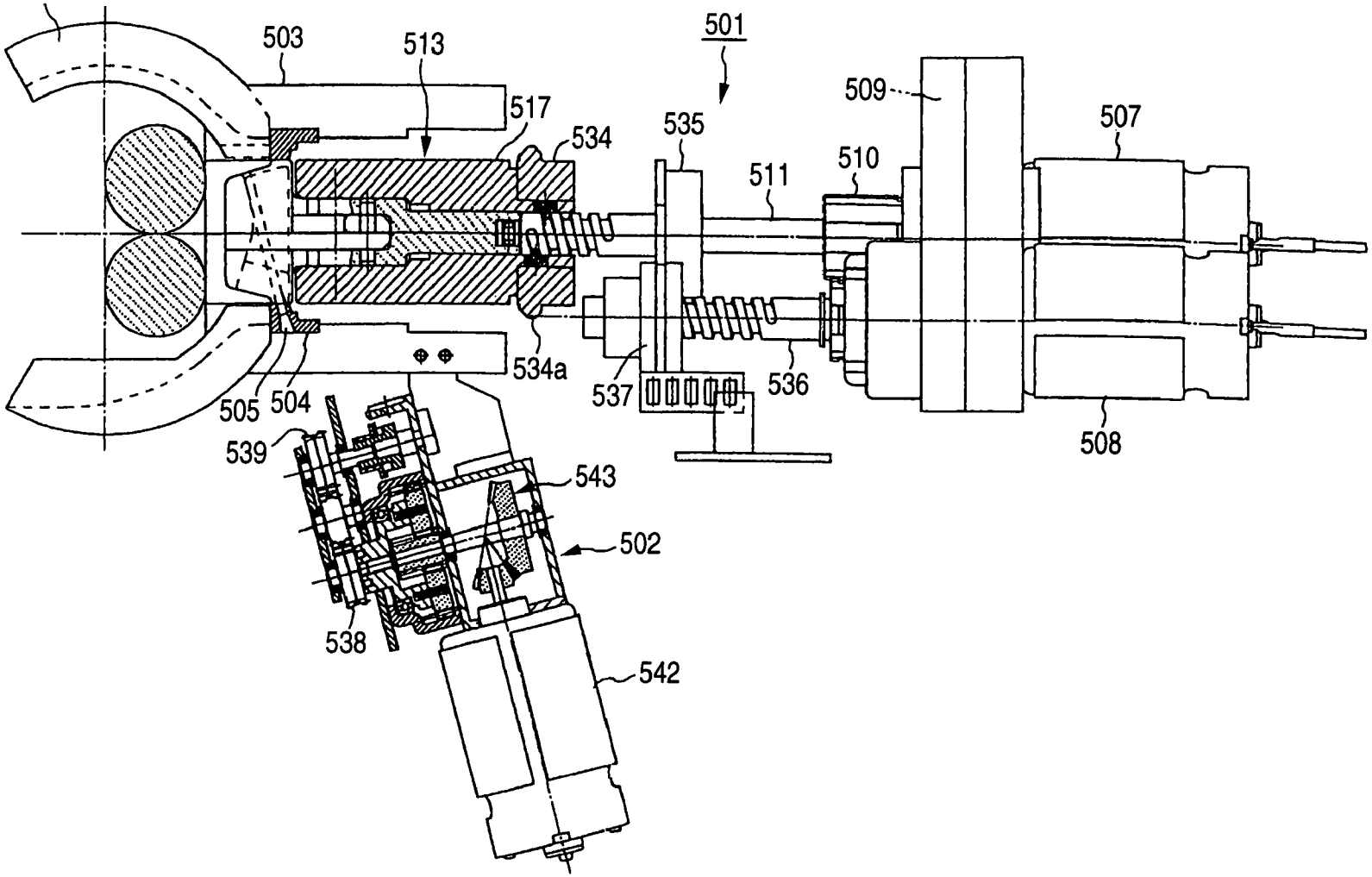
FIG. 18 is a side sectional view of a mechanism portion of a reinforcing bar binder.

Next, a detailed description will be given of other embodiment according to the binding line clamp apparatus of the reinforcing bar binder of the invention in reference to the drawings as follows. FIG. 18 shows the binding line twist mechanism 501 and the binding line feed mechanism 502 of the reinforcing bar binder, which are included in a casing (not illustrated) having a grip similar to a hand-held tool of a nailing machine or the like. The wire wound around a wire reel (not illustrated) is supplied to the circular arc shape nose 506 by passing a binding line guide hole 505 of a cutter block 504 provided at a nose portion 503. The binding line twist mechanism 501 includes two motors of the twist motor 507 and the slide motor 508 and the twist motor 507 drives a final gear 510 via a reduction gear 509. A center hole of the final gear 510 is fitted with the ball screw shaft 511 by a spline and a front end of the ball screw shaft 511 is coupled with the binding line clamp apparatus 513.

Figure 19:
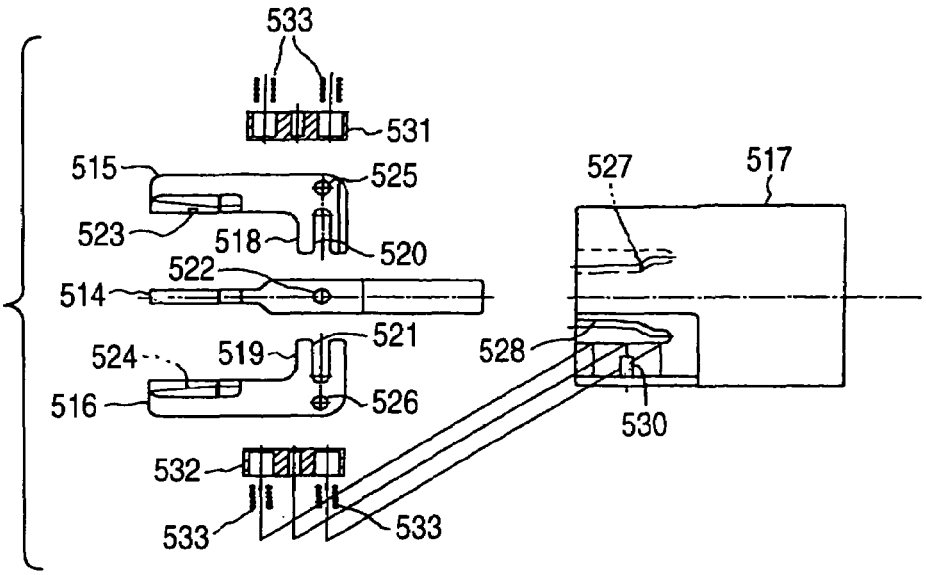
FIG. 19 is a disassembled plane view of a binding line clamp apparatus according to the invention.
Figure 20:
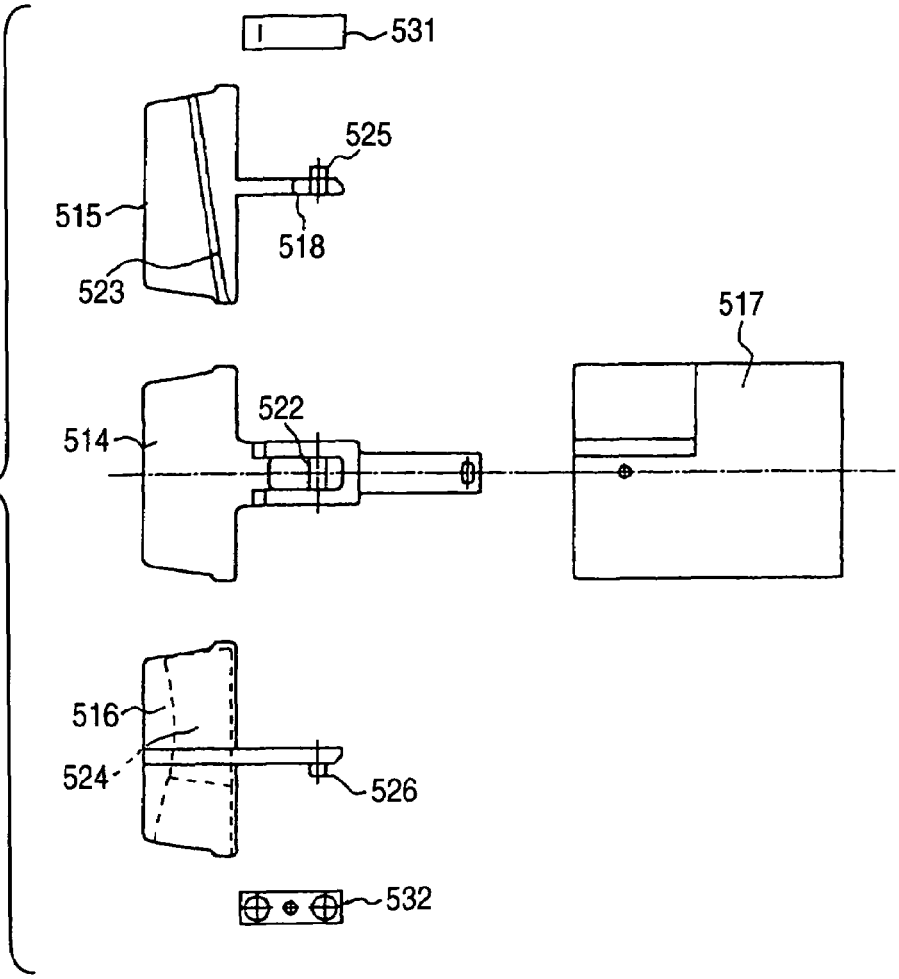
FIG. 20 is a disassembled side view of the binding line clamp apparatus according to the invention.
Figure 21:
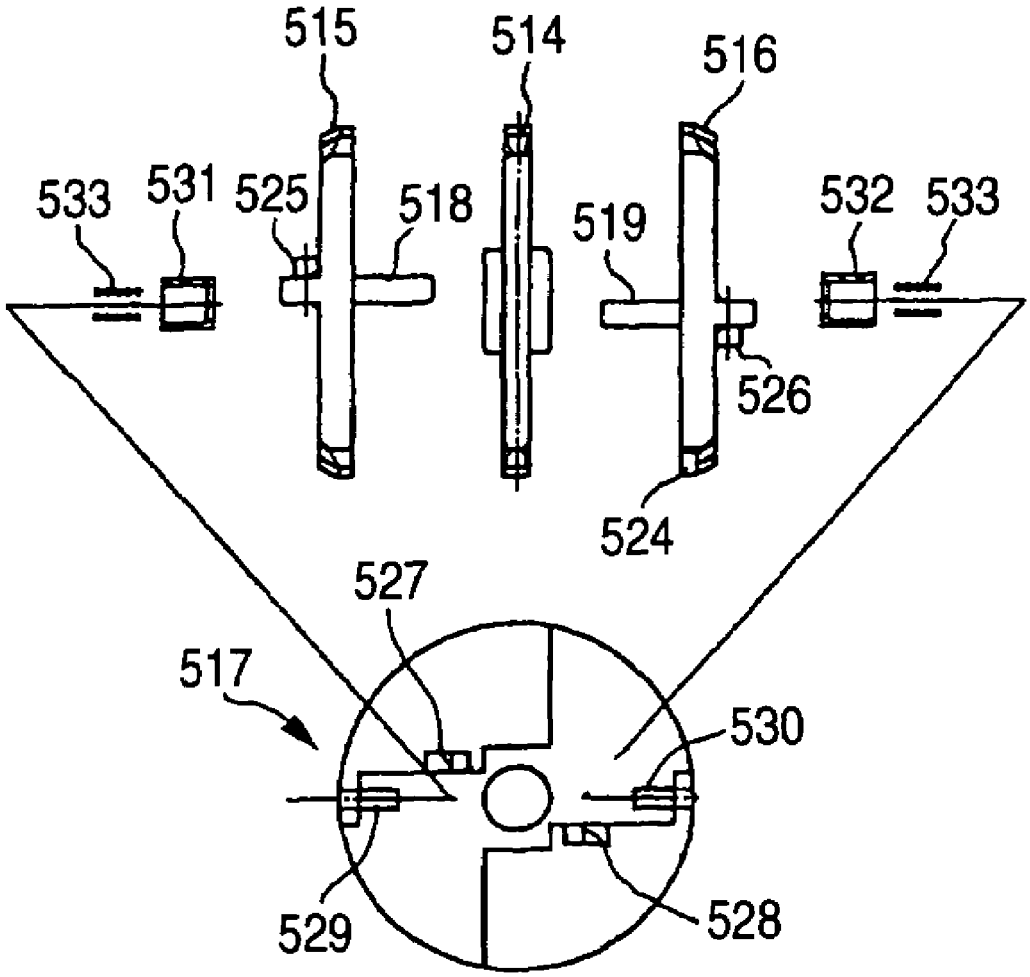
FIG. 21 is a disassembled front view of the binding line clamp apparatus according to the invention.

FIG. 19 through FIG. 21 show the binding line clamp apparatus 513, numeral 514 designates the center clamp plate coupled to front end of the ball screw shaft 511, numeral 515 designates the right clamp plate, numeral 516 designates the left clamp plate and numeral 517 designates the sleeve. The right clamp plate 515 and the left clamp plate 516 are formed with arm portions 518, 519 bent in right angle from rear portions thereof to inner sides thereof, guide grooves 520, 521 are engaged with a guide pin 522 of the center clamp plate 514, and three the clamp plates 514, 515, 516 are integrated in a state of overlapping the left and right arm portions 518, 519.

As shown by FIG. 21, an inner side face of the right clamp plate 515 is formed with a binding line guide groove 523 constituting a path of feeding out the binding line, an inner side face of the left clamp plate 516 is formed with a recess 524 in a channel-like shape reaching a vicinity of an upper end thereof from a lower end thereof, the wire fed out to the circular arc shape nose 506 by passing the guide groove 523 of the right clamp plate 515 is formed in a loop shape and a front end thereof is introduced from the lower side to the recess 528 of the recess 528 of the left clamp plate 516 and impinges on a ceiling portion of the recess 524 to stop.

An upper face of a rear portion of the right clamp plate 515 and a lower face of a rear portion of the left clamp plate 516 are respectively provided with the guide pins 525, 526. As shown by FIG. 19, the sleeve 517 holding three clamp plates 514, 515, 516 is formed with cams 527, 528 in correspondence with the guide pins 525, 526 of the left and right clamp plates 515, 516 and pusher guide pins 529, 530 projected from two left and right wall faces thereof in the center direction. The cams 527, 528 are not constituted by groove cams of an assuredly moving type pinching two side faces of the guide pins but are constituted by cams brought into contact with inner side faces of the guide pins 525, 526 and intervals of the left and right cams are narrowed at a front portion of the sleeve 517 and expanded at a rear portion thereof.

Numerals 531, 532 designate pushers attached to inside of the sleeve 517, compression coil springs 533 are inserted into spring receive holes on two left and right sides of the back faces thereof, pin holes at centers of the back faces of the pushers 531, 532 are engaged with the pusher guide pins 529, 530 and three clamp plates 514, 515, 516 are integrated into the sleeve 517 from the front side of the sleeve 517. The left and right cam plates 515, 516 are respectively brought into elastic contact with the cams 527, 528 by being pushed by the pushers 531, 532.

Figure 22A:
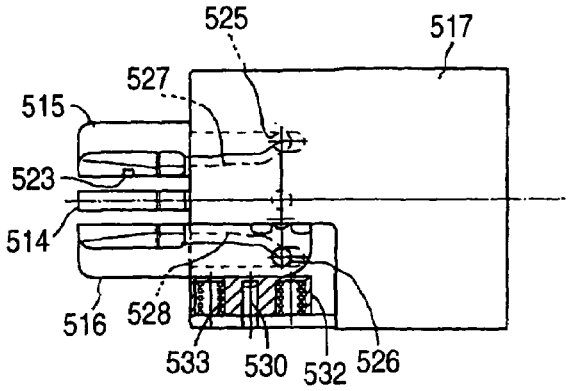
FIG. 22(*a*) through FIG. 22(*c*) show the binding line clamp apparatus in an initial state, FIG. 22(*a*) is a plane view, FIG. 22(*b*) is a front view and FIG. 22(*c*) is a side sectional view.
Figure 22B:
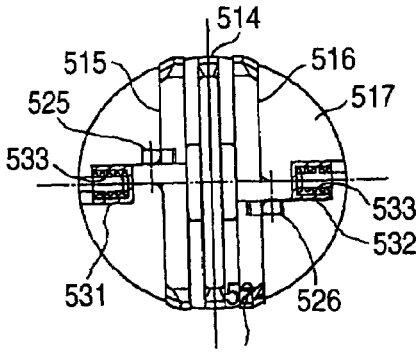
Figure 22C:
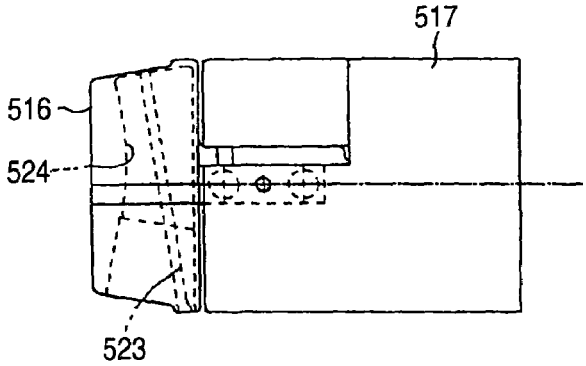
Figure 23A:
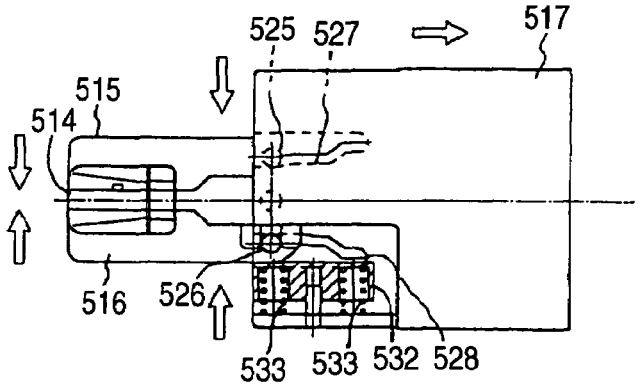
FIG. 23(*a*) through FIG. 23(*c*) show the binding line clamp apparatus in a clamp state, FIG. 23(*a*) is a plane view, FIG. 23(*b*) is a front view and FIG. 23(*c*) is a side sectional view.
Figure 23B:
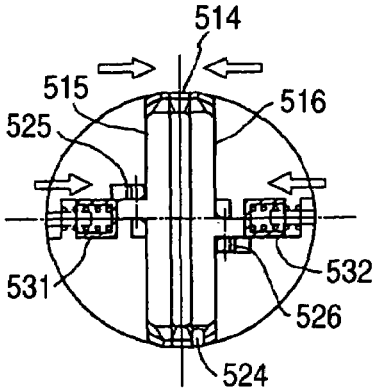
Figure 23C:
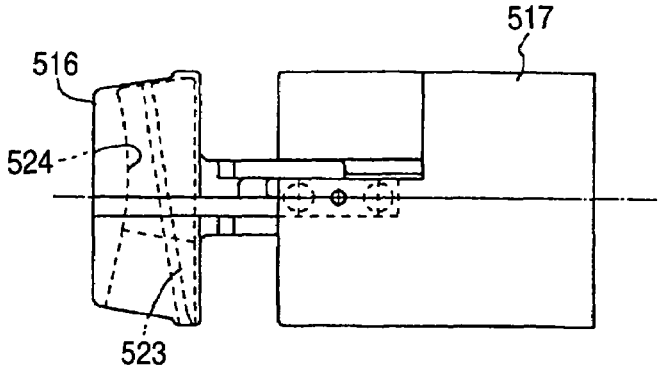

FIG. 22(*a*) through FIG. 22(*c*) show a state of an initial position at which the sleeve 517 is moved forward to three clamp plates 514, 515, 516, the guide pins 525, 526 of the left and right clamp plates 515, 516 are disposed at rear portions of the cams 527, 528 and the left and right clamp plates 515, 516 are separated from the center clamp plate 514 by pushing down the pushers 531, 532 to outer sides. As shown by FIG. 23(*a*) through FIG. 23(*c*), when the sleeve 517 is moved rearward from the front initial position, by narrowing an interval between the cams 527, 528 with which the guide pins 525, 526 of the left and right clamp plates 515, 516 are brought into contact, the left and right clamp plates 515, 516 approach each other by being pushed by the pushers 531, 532 and finally pinch the center clamp plate 514. A force of clamping the left and right clamp plates 515, 516 is constituted by spring forces of the two compression coil springs 533 and when a force equal to or more than the spring forces of the compression coil springs 533 is exerted to faces on inner sides of the clamp plates 515, 516, the left and right clamp plates 515, 516 are moved rearward to outer sides.

As shown by FIG. 18, the sleeve 517 is fitted to the ball screw shaft 511 and a ball holding ring 534 having a rotation stopping fin 534*a* is fitted to a rear end of the sleeve 517. When the twist motor 507 is rotated in the regular direction, the sleeve 517 is moved rearward by rotating the ball screw shaft 511. At a frontmost position constituting the initial position, the rotation stopping fin 534*a* of the ball holding ring 534 is engaged with a rotation stopping claw (not illustrated) provided at the casing to thereby bring the binding line clamp apparatus 513 in an unrotatable state.

The middle portion of the ball screw shaft 511 is attached with the shifter disk 535 rotatable relative to the ball screw shaft 511. The shifter disk 535 is connected to the ball holding ring 537 fitted to the ball screw shaft 536 of the slide motor 508 and the ball screw 511 and the binding line clamp apparatus 513 of the binding line twist mechanism 501 are moved in the front and rear direction in accordance with the direction of rotating the slide motor 501.

Figure 24:
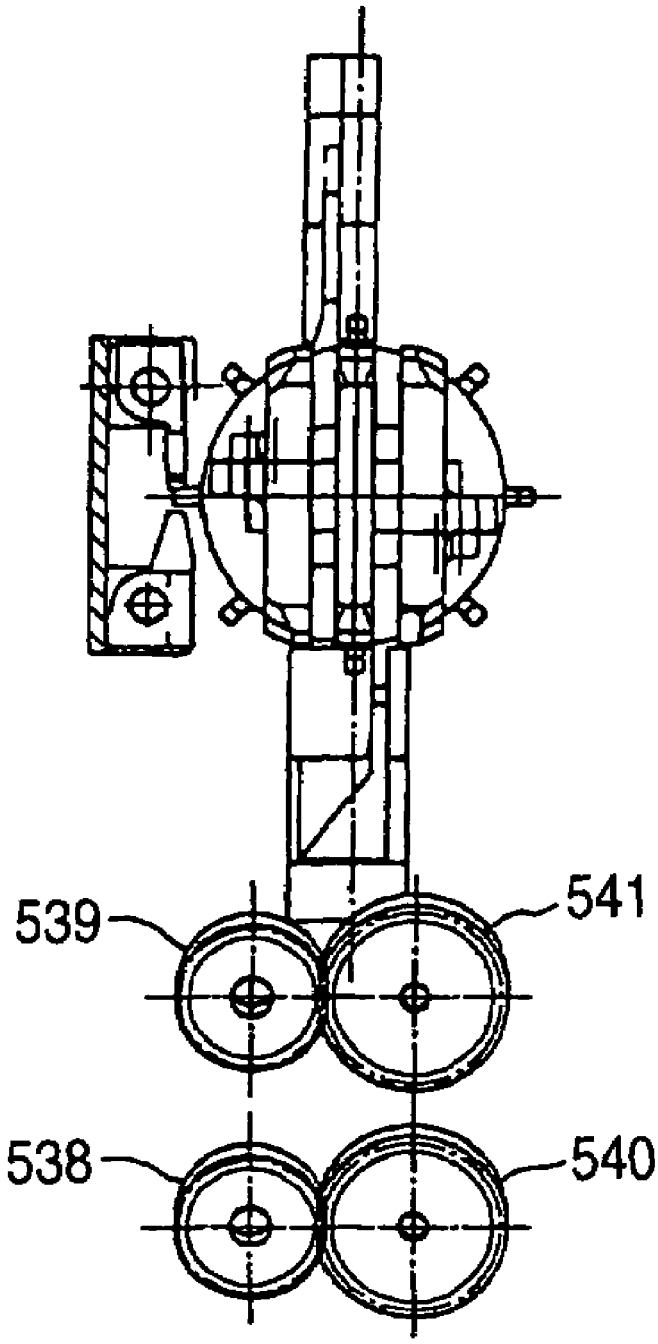
FIG. 24 is a front explanatory view showing an arrangement of a binding line feed mechanism.

As shown by FIG. 24, the binding line feed mechanism 502 is constituted by two pieces of drive gears with V-grooves 538, 539 arranged frontwardly and rearwardly along a direction of moving forward the wire W and two pieces of driven gears with V-grooves 540, 541 brought in mesh with the drive gears with V-grooves 538, 539 and two pieces of the drive gears with V-grooves 538, 539 are transmitted with power from a feed motor 542 shown in FIG. 18 via a reduction gear train 543 and the wire is pinched to feed out by the drive gears with V-grooves 538, 539 and the driven gears with V-grooves 540, 541.

Figure 25A:
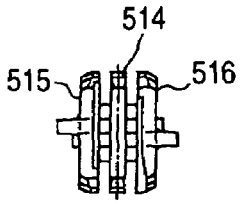
FIG. 25(*a*) and FIG. 25(*b*) show a binding line clamp apparatus in an initial state, FIG. 25(*a*) is a front view and FIG. 25(*b*) is a side sectional view.
Figure 25B:
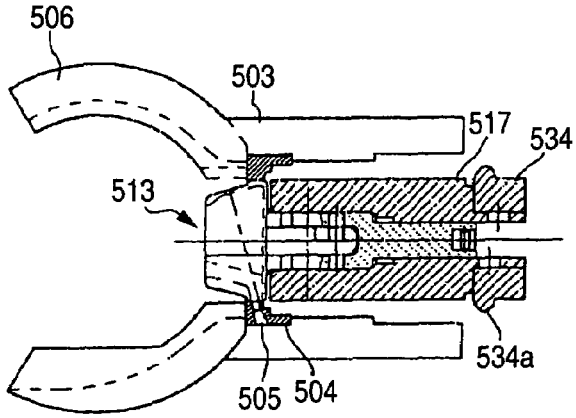
Figure 26A:
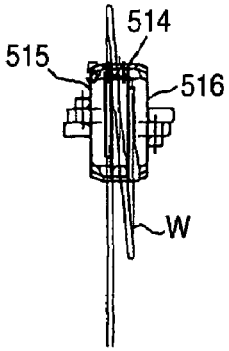
FIG. 26(*a*) and FIG. 26(*b*) show the binding line clamp apparatus in a step of feeding the binding line, FIG. 26(*a*) is a front view and FIG. 26(*b*) is a side sectional view.
Figure 26B:
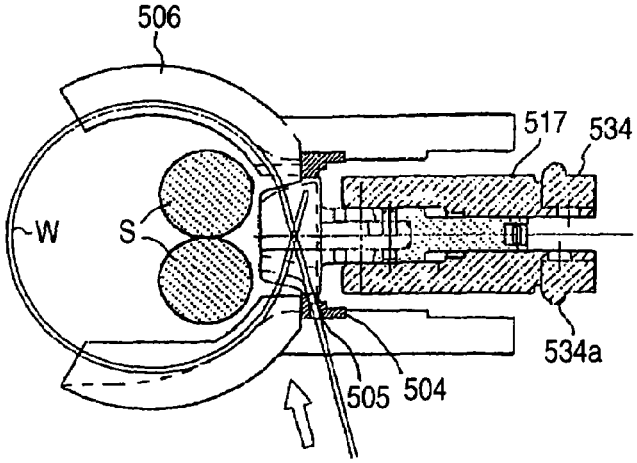

Next, an explanation will be given of operation of the binding line clamp apparatus 513. FIG. 25(*a*) and FIG. 25(*b*)

show the initial state and when a trigger is pulled from the state, the twist motor 507 is rotated in the regular direction by a predetermined rotational number and as shown by FIG. 26(*a*) and FIG. 26(*b*), the sleeve 517 is moved rearward and the interval between the left and right clamp plates 515, 516 is narrowed, however, the left and right clamp plates 515, 516 are not brought into close contact with the center clamp plate 514 yet.

Successively, the feed motor 542 of the binding line feed mechanism 502 is started and the wire W reeled out to the circular arc shape nose 506 by passing the binding line guide groove 523 of the right clamp plate 515 by rotating two front and rear pairs of the drive gears with V-grooves 538, 539 and driven gears with V-grooves 540, 541 is bent in the loop shape along the shape of the guide groove at the inner periphery of the circular arc shape nose 506, passes around the surrounding of the reinforcing bar S and the front end of the wire W moves forward from the opening of the lower face of the clamp plate 516 into the recess 524 and impinges on the ceiling portion of the recess 524 to stop. The amount of feeding the wire W is controlled by a control apparatus (not illustrated).

Figure 27A:
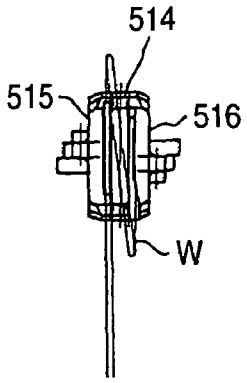
FIG. 27(*a*) and FIG. 27(*b*) show the binding line clamp apparatus in a step of pulling back the binding line, FIG. 27(*a*) is a front view and FIG. 27(*b*) is a side sectional view.
Figure 27B:
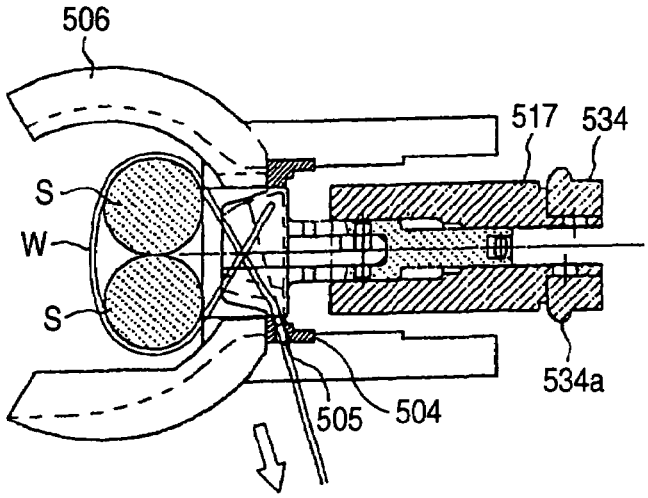

After stopping the feed motor 542, the twist motor 507 of the binding line twist mechanism 501 is started, as shown by FIG. 27(*a*) and FIG. 27(*b*), the sleeve 517 is moved further rearward, the left clamp plate 516 is brought into contact with the center clamp plate 514 to pinch the front end of the wire W, the wire W is pulled back by reversely driving to rotate the feed motor 542 and the wire W is wound around the reinforcing bar S.

Figure 28A:
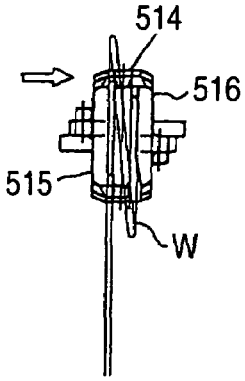
FIG. 28(*a*) and FIG. 28(*b*) show the binding line clamp apparatus in a step of grasping the binding line, FIG. 28(*a*) is a front view and FIG. 28(*b*) is a side sectional view.
Figure 28B:
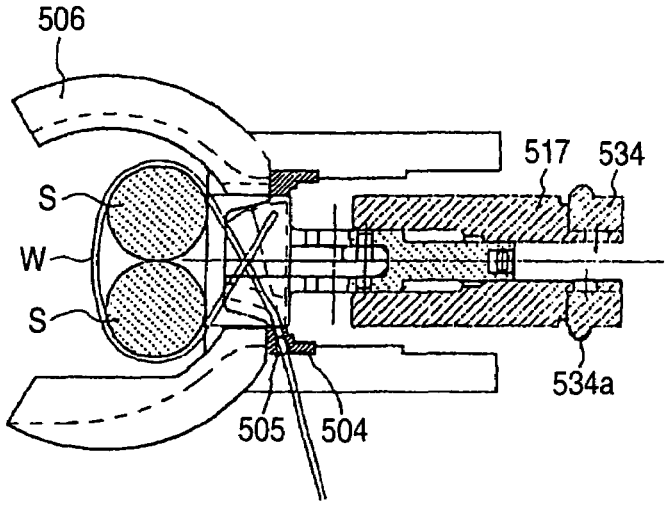
Figure 29A:
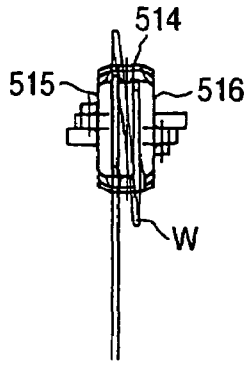
FIG. 29(*a*) and FIG. 29(*b*) show the binding line clamp apparatus in a step of cutting the binding line, FIG. 29(*a*) is a front view and FIG. 29(*b*) is a side sectional view.
Figure 29B:
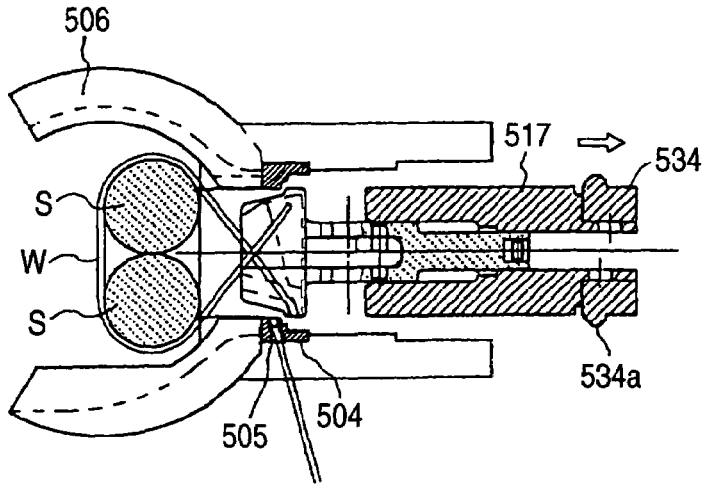

Successively, as shown by FIG. 28(*a*) and FIG. 28(*b*), the sleeve 517 is moved further rearward, also the right clamp plate 515 is closed to pinch the wire W solidly, the slide motor 508 is regularly driven to rotate and as shown by FIG. 29(*a*) and FIG. 29(*b*), the binding line clamp apparatus 513 is moved rearward. By moving the wire W grasped by the binding line clamp apparatus 513 in parallel relative to the binding line guide hole 505 of the cutter block 504, a rear end portion of the wire W wound around the reinforcing bar S is sheared. At this occasion, the wire W grasped by the binding line clamp apparatus 513 is pulled by the reinforcing bar S, the wire is slid among the clamp plates 514, 515, 516 of a spring pressure type and is pulled out from the center in the up and down direction of the front face of the binding line clamp apparatus 513 to produce an allowance of constituting a twist margin at the binding line loop.

Figure 30A:
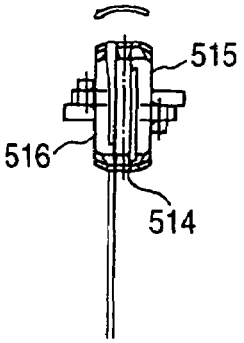
FIG. 30(*a*) and FIG. 30(*b*) show the binding line clamp apparatus in a step of twisting the binding line, FIG. 30(*a*) is a front view and FIG. 30(*b*) is a side sectional view.
Figure 30B:
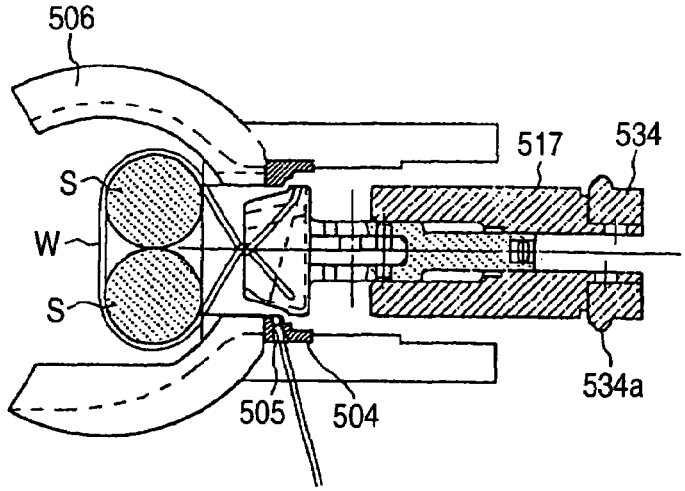
Figure 31A:
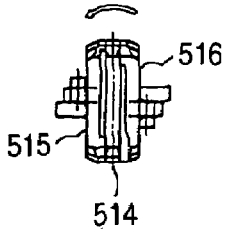
FIG. 31(*a*) and FIG. 31(*b*) show the binding line clamp apparatus in a state of finishing to twist the binding line, FIG. 31(*a*) is a front view and FIG. 31(*b*) is a side sectional view.
Figure 31B:
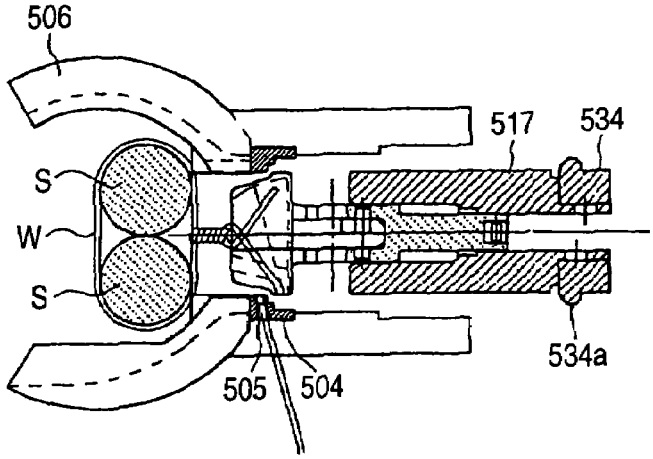

Successively, the twist motor 507 is regularly driven to rotate, since the rotation stopping fin 534*a* of the ball holding ring 534 moved rearward from the initial position is detached from the rotation stopping claw of the casing, as shown by FIG. 30(*a*) and FIG. 30(*b*), the wire W is twisted by rotating the binding line clamp apparatus 513. FIG. 31(*a*) and FIG. 31(*b*) show a state of finishing to twist, since the front end the rear end of the binding line loop are clamped to twist and therefore, lengths of extra portions extended from the knot portion of the wire are short and finish is beautiful.

Figure 32A:
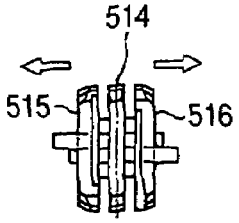
FIG. 32(*a*) and FIG. 32(*b*) show the binding line clamp apparatus in a step of releasing clamp plates, FIG. 32(*a*) is a front view and FIG. 32(*b*) is a side sectional view.
Figure 32B:
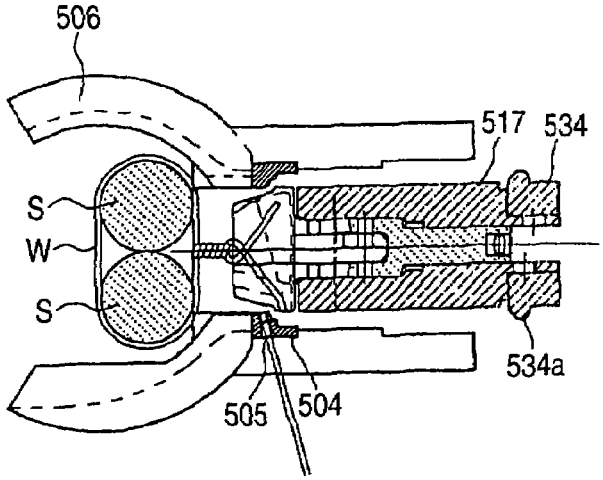

Successively, by moving forward the sleeve 517 by reversely rotating the twist motor 507, as shown by FIG. 32(*a*) and FIG. 32(*b*), the clamp plates 515, 516 are opened to release the grasped wire W and thereafter, the binding line clamp apparatus 513 is returned to the initial position shown by FIG. 25(*a*) and FIG. 25(*b*) by controlling the twist motor 507 and the slide motor 508 to thereby finish binding operation of 1 cycle.

Further, although according to the above-described embodiment, the sleeve 517 is formed with the cams 527, 528 and the left and right clamp plates 515, 516 are provided with the guide pins 525, 526, contrary thereto, there may be constructed a constitution of forming the cams at the sleeve 517 and providing the guide pins at the left and right clamp plates 515, 516. Further, although an explanation has been given by taking an example of the wire as the binding line, a wire other than the metal wire may be used.

Further, the invention is not limited to the above-described embodiment but can variously be modified within the technical range of the invention and the invention naturally covers modified embodiments thereof.

Figure 33A:
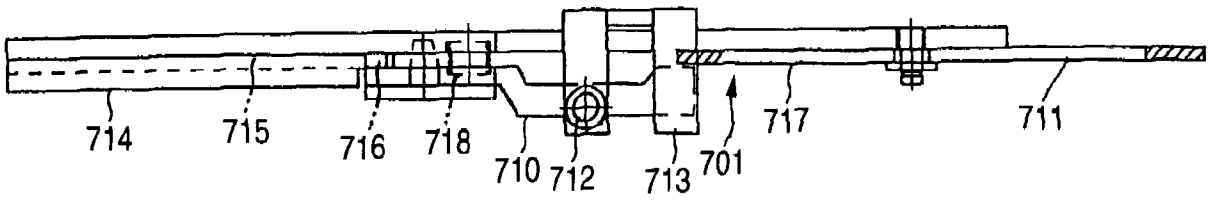
FIG. 33(*a*) and FIG. 33(*b*) show an embodiment of the invention, FIG. 33(*a*) is a plane view of a binding line guide apparatus and FIG. 33(*b*) is a side view of a mechanism portion of a reinforcing bar binder.
Figure 33B:
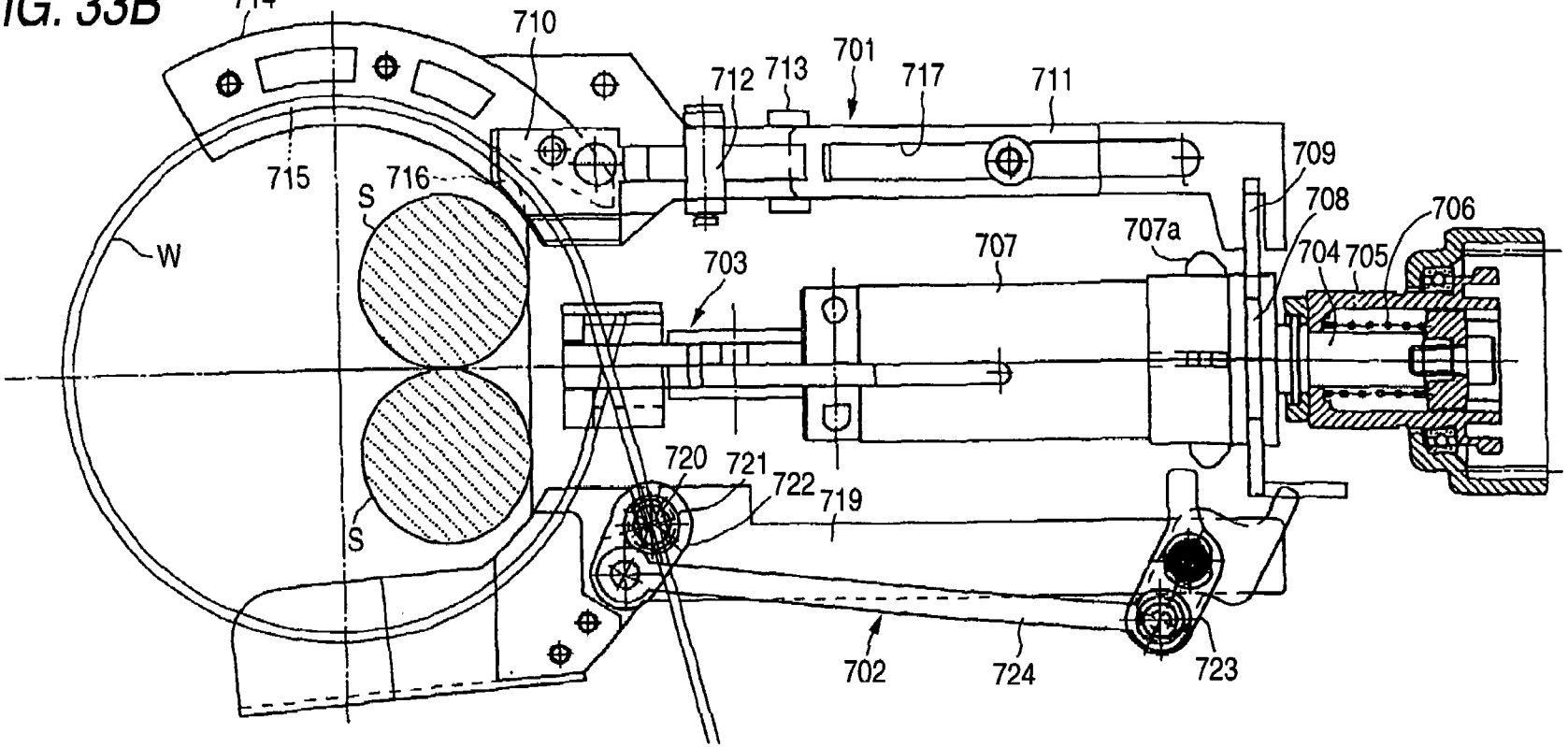

Next, a detailed explanation will be given of other embodiment according to the reinforcing bar binder of the invention in reference to the drawings. FIG. 33(*a*) and FIG. 33(*b*) show a binding mechanism portion of the reinforcing bar binder, numeral 701 designates the binding line guide apparatus and numeral 702 designates the binding cut apparatus. Numeral 703 designates the binding line clamp apparatus, a ball screw shaft 704 of the binding line clamp apparatus 703 is coupled to a drive shaft 705 driven to rotate by way of a twist motor and a reduction gear mechanism (not illustrated) by a spline and is pushed down to a rear position by a compression coil spring 706 inserted into the drive shaft 705. A groove 708 in a peripheral direction formed at a rear end portion of the sleeve 707 of the binding line clamp apparatus 703 is engaged with the shifter plate 709 and by the shifter plate 709 moved in the front and rear direction along with the sleeve 707, the binding line guide apparatus 701 arranged on the upper side and the binding line cut apparatus 702 arranged on the lower side are driven.

The binding line guide apparatus 701 is constituted to drive the guide plate 710 pivotable in the lateral direction by the slide cam plate 711 and the shaft 712 of the guide plate 710 in a lever shape is attached to the support frame 713. An inner peripheral face of the nose 714 is provided with the guide groove 715 in the peripheral direction, a side face of a base portion of the nose 714 is partially notched and a front end portion of the guide plate 710 is fitted to the notched portion.

Figures 34A, 34B:
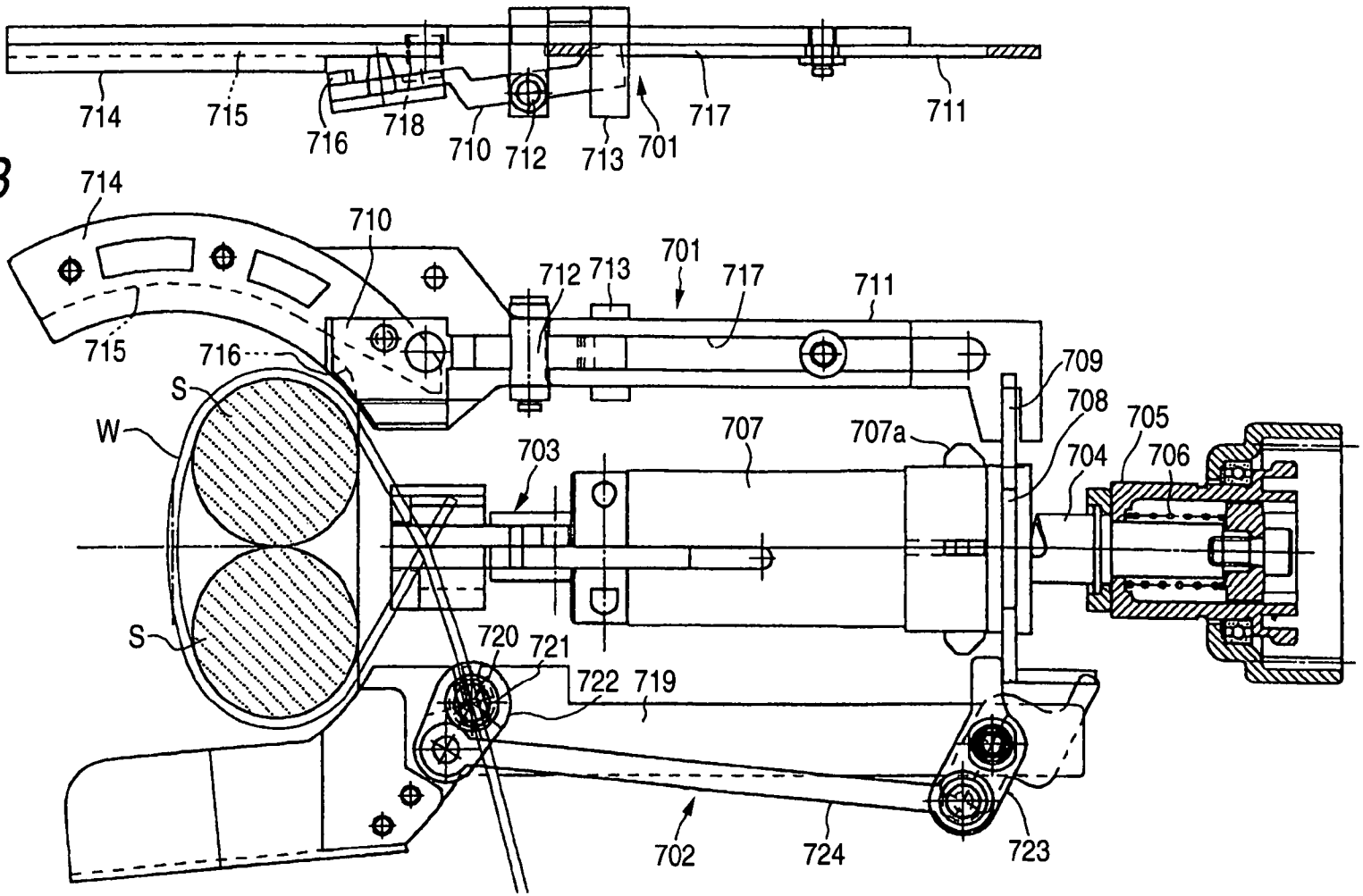
FIG. 34(*a*) and FIG. 34(*b*) show a step of pulling back the binding line of the reinforcing bar binder, FIG. 34(*a*) is a plane view of the binding line guide apparatus and FIG. 34(*b*) is a side view of the reinforcing bar binder.

As shown by FIG. 34(*a*), a side face of a front end portion of the guide plate 710 is formed with the forming portion 716 with which the binding line is brought into contact and in the initial state shown by FIG. 33(*a*) and FIG. 33(*b*), the forming portion 716 is brought into contact with the notched portion of the nose 714 and therefore, the wire W is passed through an interval between the forming portion 716 and the guide groove 715 of the nose 714, fed out along the guide groove 716, bent by the forming-portion 716 at this occasion and formed in the circular arc shape.

A side face of the slide cam plate 711 is formed with the long hole 717 in the front and rear direction and at the initial state, a rear end portion of the guide plate 710 is brought into contact with a plane portion frontward from the long hole 717. A rear end portion of the slide cam plate 711 is engaged with the shifter plate 709 and the sleeve 707 and the slide cam plate 711 are slid integrally in the front and rear direction. When the slide cam plate is moved forward from the initial position, as shown by FIG. 34(*a*), the rear end portion of the guide plate 710 falls into the long hole 717 of the slide cam plate 711 by being urged by a compression coil spring 718 and the forming portion at the front portion is separated from the nose 714. Further, when the slide cam plate 711 returns to the initial position, the rear end portion of the guide plate 710 comes out from the long hole 717 and the forming portion 716 at the front portion is brought into contact with the notched portion of the nose 714.

The binding line cut apparatus 2 of FIG. 33(*a*) and FIG. 33(*b*) is a rotary wire cutter forming a hole traversing an axis center of the pin 720 fixed at the front portion of the frame 719 and forming holes having wide widths at two front and rear faces of the cylindrical sleeve 721 mounted to the pin 720 and a front lever 722 attached with the cylindrical sleeve 721 and the rear lever 723 are connected by a link 724. The binding line cut apparatus 702 is set to the initial state of the FIG. 33(*a*) and FIG. 33(*b*) by a spring (not illustrated) and at this occasion, the holes of the pin 720 and the cylindrical sleeve 721 coincide with each other and the wire W is fed out by passing the hole of the pin 702. When the sleeve 707 of the binding line clamp apparatus 703 is moved forward, the rear lever 723 of the binding line cut apparatus 702 is pushed forward by the shifter plate 709, the cylindrical sleeve 721 at the front portion is rotated in cooperation therewith and the wire W is cut at an outlet of the hole of the pin 720.

Figure 35:
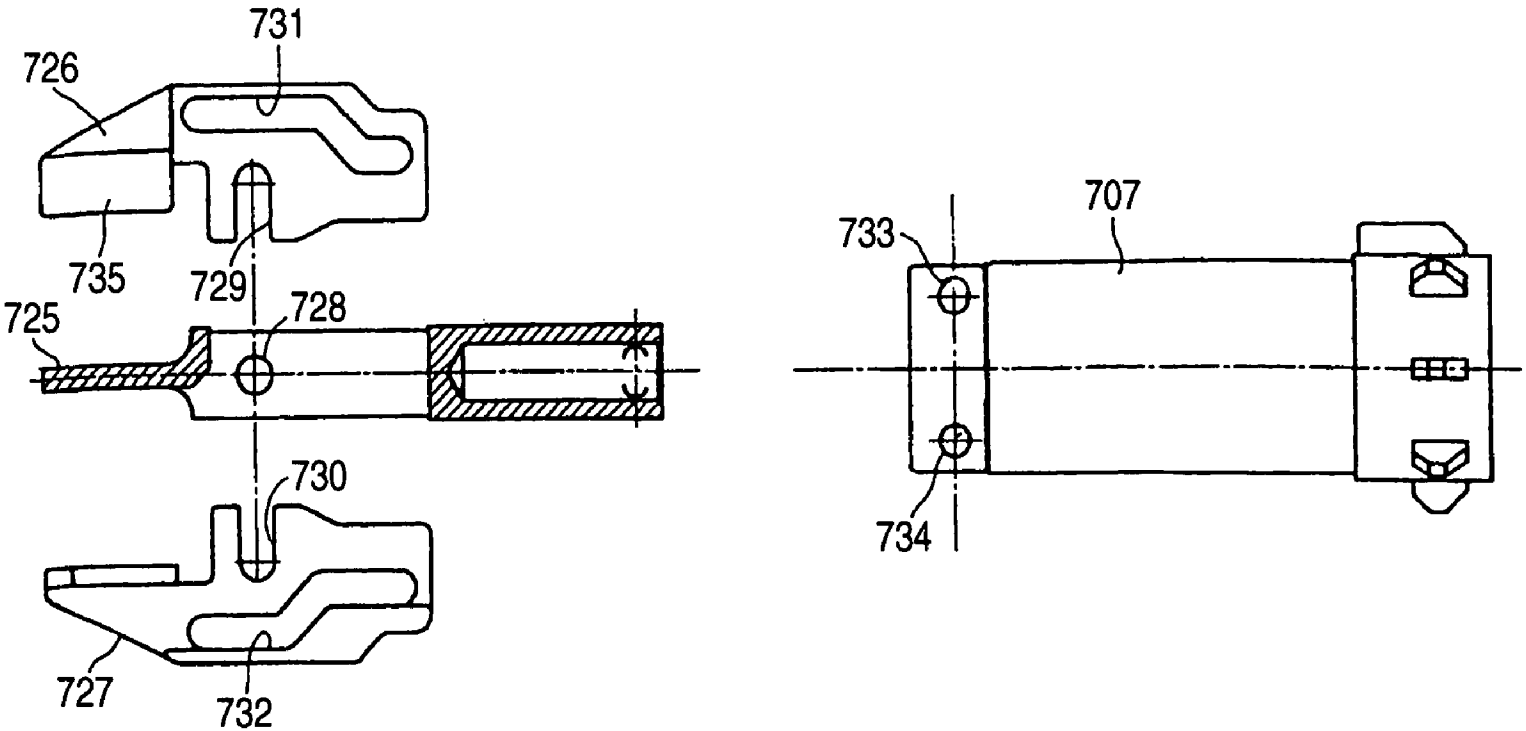
FIG. 35 is a disassembled plane view of a binding line clamp apparatus.
Figure 36:
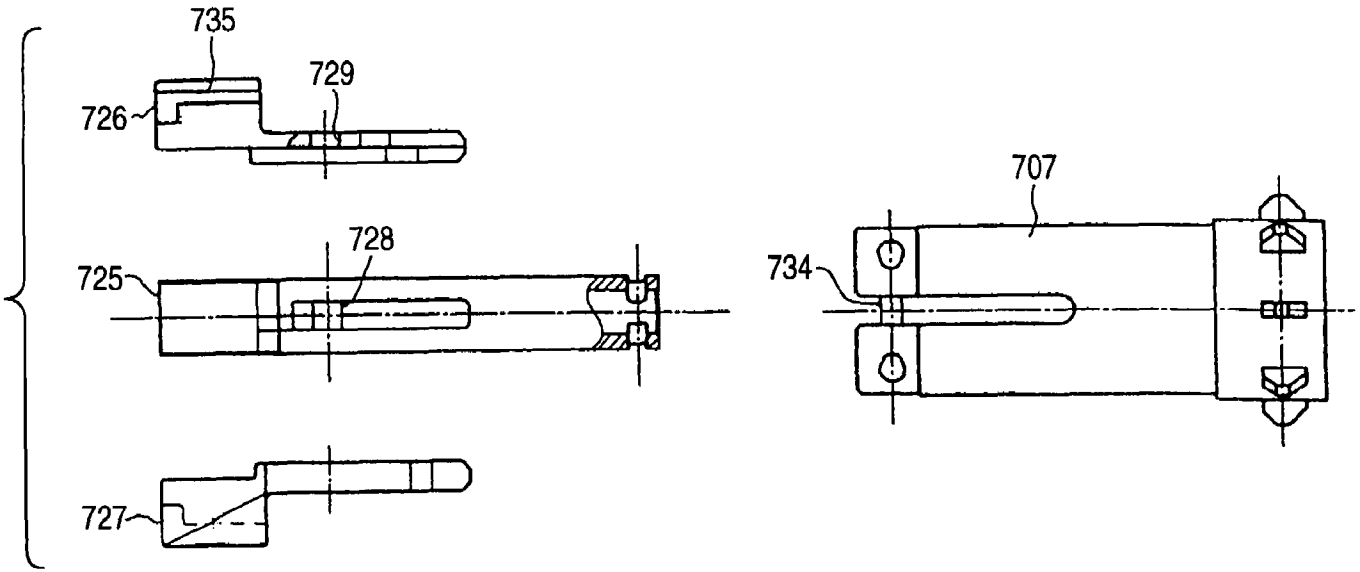
FIG. 36 is a disassembled side view of the binding line clamp apparatus.
Figure 37:
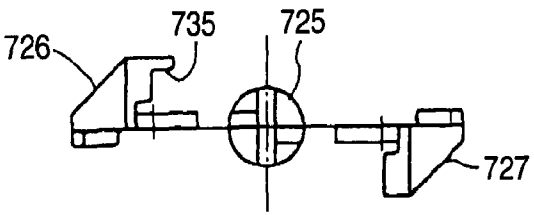
FIG. 37 is a front view of three pieces of clamp plates.

FIG. 35 through FIG. 37 show constituent members of the binding line clamp apparatus 303, numeral 725 designates a center clamp plate, numeral 736 designates a right clamp plate, numeral 727 designates a left clamp plate and the sleeve 707 is outwardly mounted to a shaft portion of the center clamp plate 725. A middle portion of the center clamp plate 725 is provided with a guide pin 728 in a longitudinal direction, side guide grooves 729, 730 formed at inner side faces of the left and right clamp plates 726, 727 are engaged with the guide pin 728 and the left and right clamp plates 726, 727 are openably and closably integrated to the center clamp plate 725. The left and right clamp plates 726 and 727 are formed with groove cams 731, 732 and the groove cams 731, 732 are engaged with the guide pins 733, 734 of the sleeve 7. The groove cams 731, 732 are constituted by a step-like shape moving front portions thereof to outer sides relative to rear portions thereof in parallel and there is constituted a structure in which when the sleeve 707 is moved forward relative to three pieces of the clamp plates 725, 726, 727, the left and right clamp plates 726, 727 are moved in directions of approaching each other to pinch the center clamp plate 725. Phases of the groove cams 731, 732 of the left and right clamp plates 725, 727 are shifted from each other, when moving forward the sleeve 707, first, the right clamp plate 726 is brought into contact with the center clamp plate and thereafter, the left clamp plate is brought into contact with the center clamp plate 725.

Figure 38A:
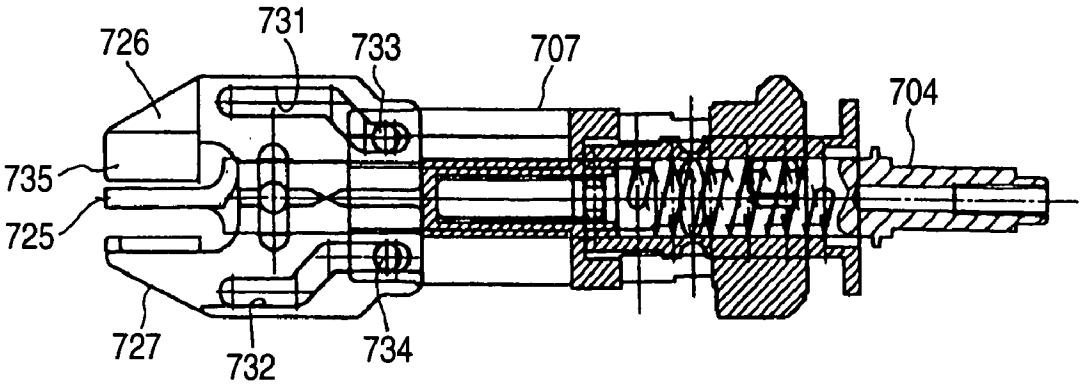
FIG. 38(*a*) through FIG. 38(*c*) show an initial state of the binding line clamp apparatus, FIG. 38(*a*) is a plane sectional view, FIG. 38(*b*) is a front sectional view and FIG. 38(*c*) is a side sectional view.
Figure 38C:
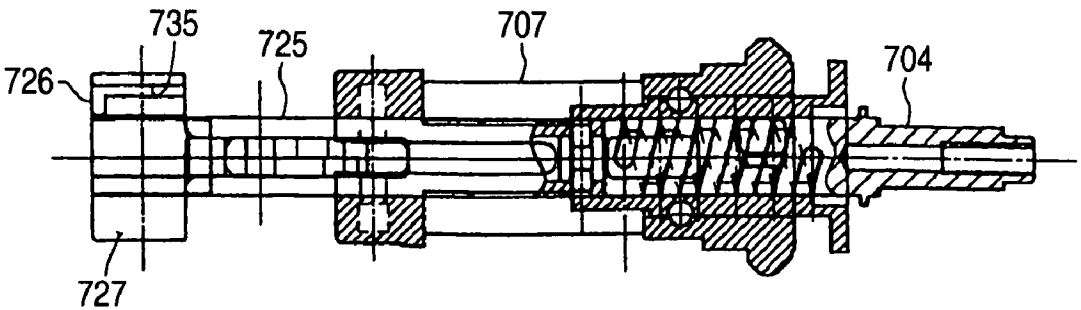
Figure 38B:
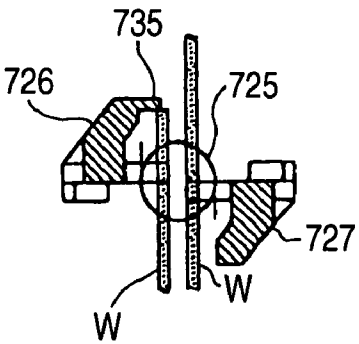

FIG. 38(*a*) through FIG. 38(*c*) show a state of integrating three pieces of the clamp plates 725, 726 and 727 and the sleeve 707 and the ball screw shaft 704, the shaft portion of the center clamp plate 725 is rotatably connected to the ball screw shaft 704 and a ball (not illustrated) attached to an inner peripheral face of the sleeve 707 is brought in mesh with the ball screw shaft 704. As shown by FIG. 38(*b*), a portion of an inner side face of the right clam plate 726 (left upper one in FIG. 38(*b*)) above a middle portion in the up and down direction is constituted by an inclined face approaching in the center direction and formed with a stopper portion 725 projected from an upper end of the inclined face horizontally to the center direction. Further, symmetrically, a portion of an inner face of the left clamp plate 727 (left lower one in FIG. 38(*b*)) from a middle portion in the up and down direction is constituted by an inclined face approaching in the center direction.

Figure 39A:
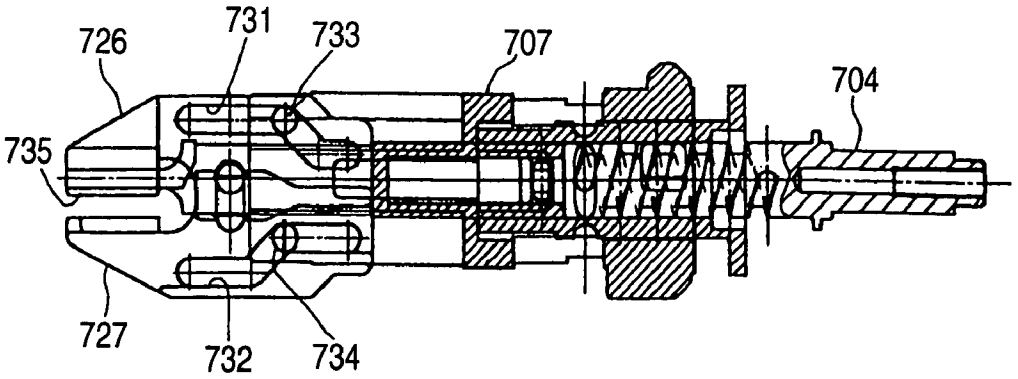
FIG. 39(*a*) through FIG. 39(C) show a step of grasping a front end of the binding line of the binding line clamp apparatus, FIG. 39(*a*) is a plane sectional view, FIG. 39(*b*) is a front sectional view and FIG. 39(*c*) is a side sectional view.
Figure 39C:
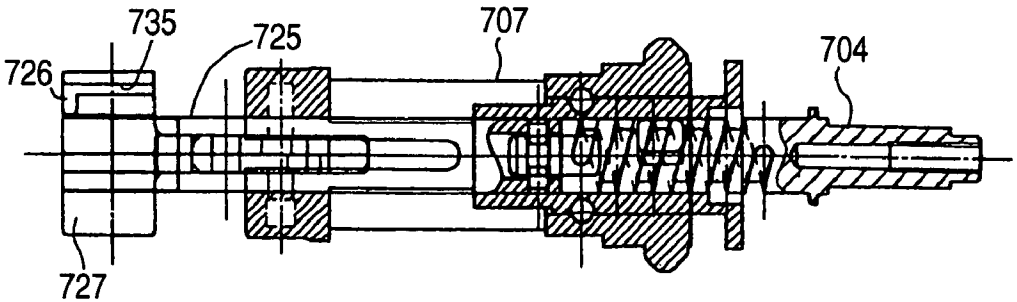
Figure 39B:
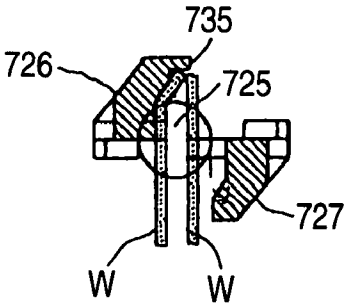

In starting the reinforcing bar binder, the wire is fed out from the lower side through an interval between the left clamp plate 727 and the center clamp plate 725 by a binding line feed apparatus (not illustrated) and the front end of the wire W fed along a nose (not illustrated) and formed in a loop shape moves forward from the lower side through an interval between the right clamp plate 726 and the center clamp plate 725 and impinges on the stopper portion 735 of the right clamp plate 726 as shown by FIG. 38(*b*) to stop. Successively, a twist motor (not illustrated) is started to move forward the sleeve 707 by rotating the ball screw shaft 704 in the counterclockwise direction in view from a side of the motor. Thereby, as shown by FIG. 39(*b*), the right clamp plate 726 is slid in the center direction to clamp the wire W and the front end of the wire W is bent in the center direction by the upper inclined face of the right clamp plate 726. Further, as shown by FIG. 40(*a*) through FIG. 40(*c*), when the sleeve 707 moves forward in the center direction, as shown by FIG. 40(*b*), the left clamp plate 727 is slid in the center direction to clamp the wire W and the rear end of the wire loop is simultaneously bent in the center direction by the lower inclined face to enter a successive twisting step.

Next, an explanation will be given of operation of the reinforcing bar binder. FIG. 33(*a*) through FIG. 33(*b*) show a state of feeding out the wire W from the initial state by the binding line feed apparatus and forming the wire loop surrounding the surrounding of the reinforcing bar S and as shown by FIG. 38(*b*), the front end of the wire W impinges on the stopper portion 735 of the right clamp plate 726 to stop.

Successively, the ball screw shaft 704 is regularly driven to rotate, as shown by FIG. 34(*a*) and FIG. 34(*b*), the sleeve 704 of the binding line clamp apparatus 703 is moved forward and clamps the front end of the wire W by closing the right clamp plate 726 as shown by FIG. 39(*b*). Simultaneously therewith, the guide plate 710 of the binding line guide apparatus 701 is escaped in the lateral direction by leaving the nose 714, the wire W is released from being restrained, the wire W is pulled back by reversely driving to rotate the biding line feed apparatus and the wire W is wound around the reinforcing bar S.

Figure 40A:
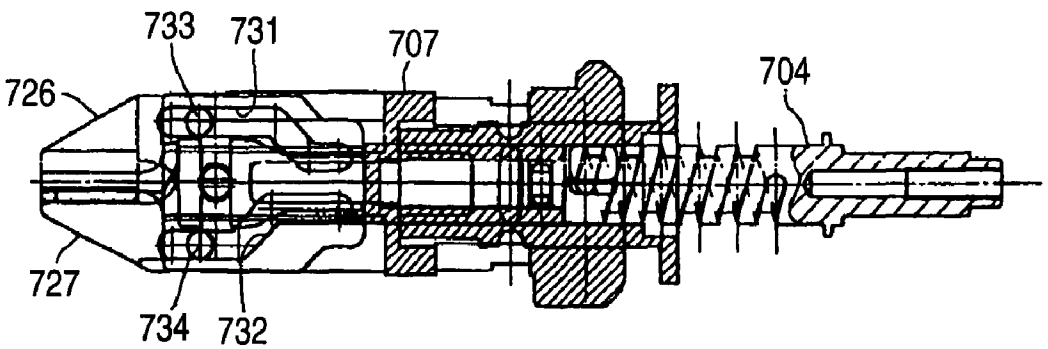
FIG. 40(*a*) through FIG. 40(*c*) show a step of grasping a rear end of the binding line of the binding line clamp apparatus, FIG. 40(*a*) is a plane sectional view, FIG. 40(*b*) is a front sectional view and FIG. 40(*c*) is a side sectional view.
Figure 40C:
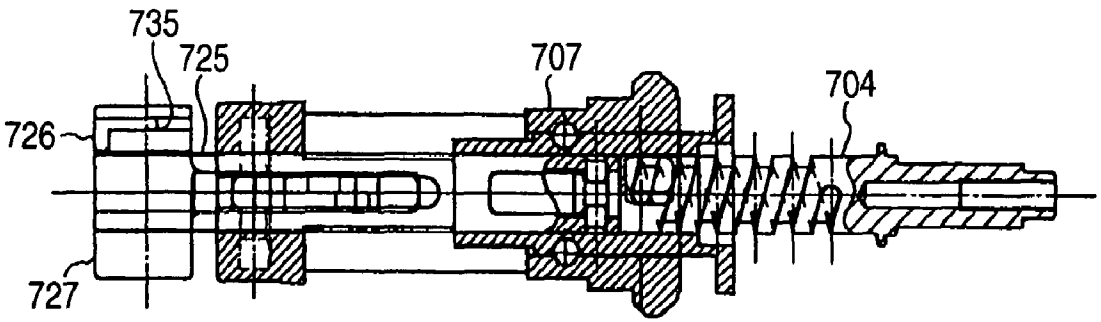
Figure 40B:
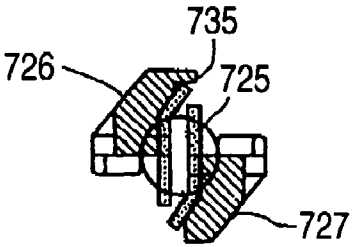
Figure 41A:
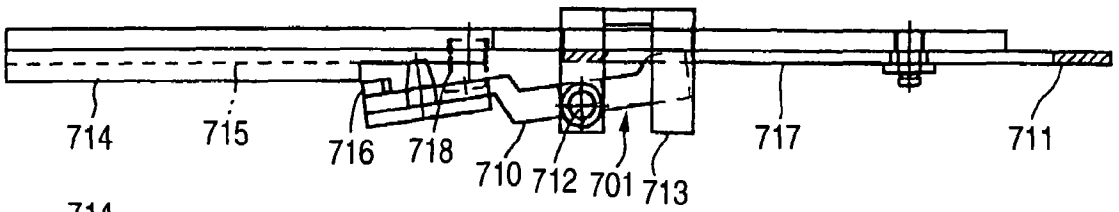
FIG. 41(*a*) and FIG. 41(*b*) show a step of grasping the rear end of the binding line of the reinforcing bar binder, FIG. 41(*a*) is a plane view of a blind line guide apparatus and FIG. 41(*b*) is a side view of the reinforcing bar binder.
Figure 41B:
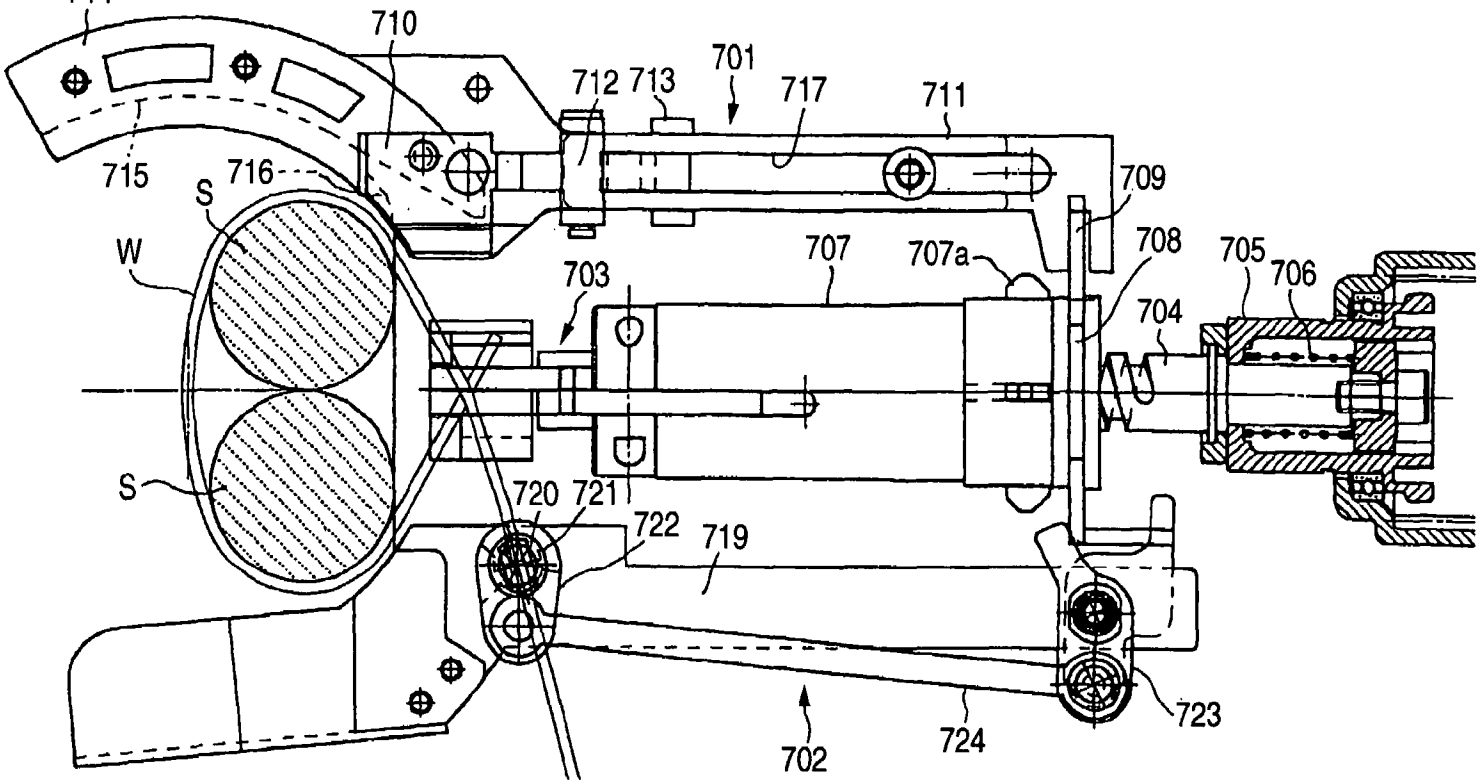
Figures 42A, 42B:
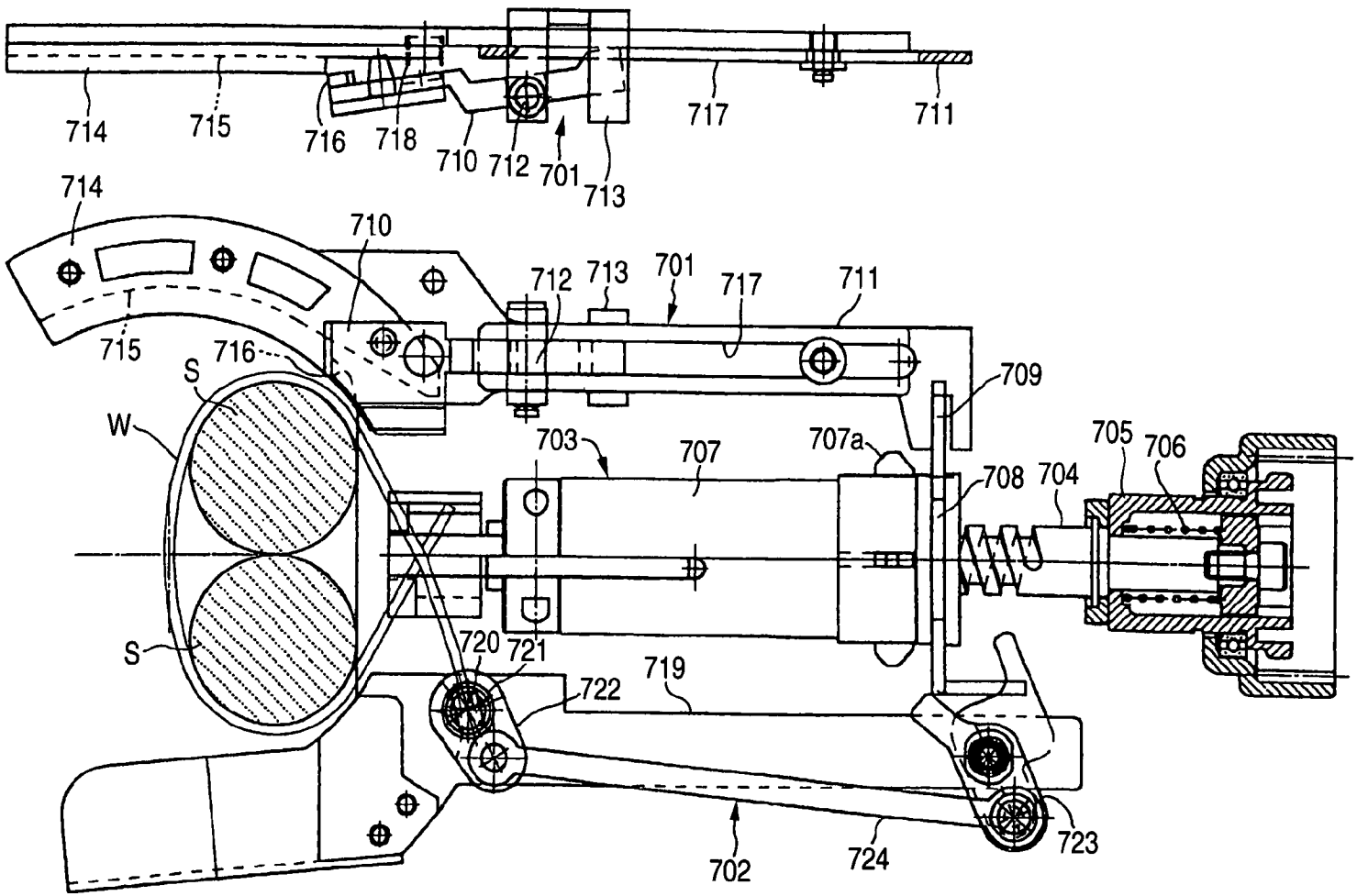
FIG. 42(*a*) and FIG. 42(*b*) show a step of cutting the binding line of the reinforcing bar binder, FIG. 42(*a*) is a plane view of the binding line guide apparatus and FIG. 42(*b*) is a side view of the reinforcing bar binder.

Further, as shown by FIG. 40(*a*) through FIG. 40(*c*) and FIG. 41(*a*) and FIG. 41(*b*), the left clamp plate 727 is closed to clamp the rear end of the wire loop and as shown by FIG. 42(*a*) and FIG. 42(*b*), the sleeve 707 is moved further forward to push the rear lever 723 of the binding line cut apparatus 702 to rotate the cylindrical sleeve 721 at the front portion to cut the wire W. Further, by moving forward the sleeve 707, the rotation stopping pin 707*a* provided at the rear end of the sleeve 707 is detached from a stopper (not illustrated) of a frame 719 and a total of the binding line clamp apparatus 703 is started to rotate to twist the wire W. At this occasion, tension of the wire W is increased in accordance with progress of twisting and the wire W is slid among the clamp plates 725, 726, 727 by constituting fulcra by end portions thereof bent by the left and right clamp plates 726, 727 and is pulled out from the center in the up and down direction of the front face of the binding line clamp apparatus 703 to twist.

Figure 43A:
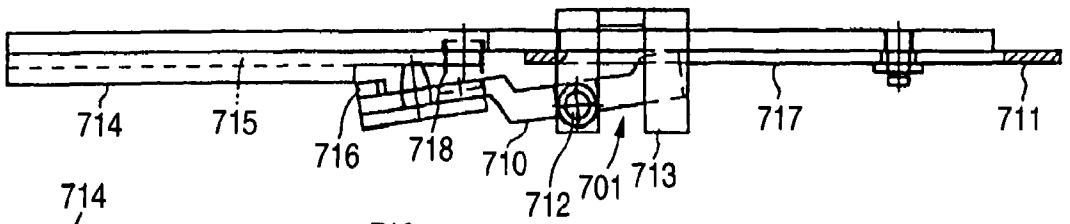
FIG. 43(*a*) and FIG. 43(*b*) show a step of twisting the binding line of the reinforcing bar binder, FIG. 43(*a*) is a plane view of the binding line guide apparatus and FIG. 43(*b*) is a side view of the reinforcing bar binder.
Figure 43B:
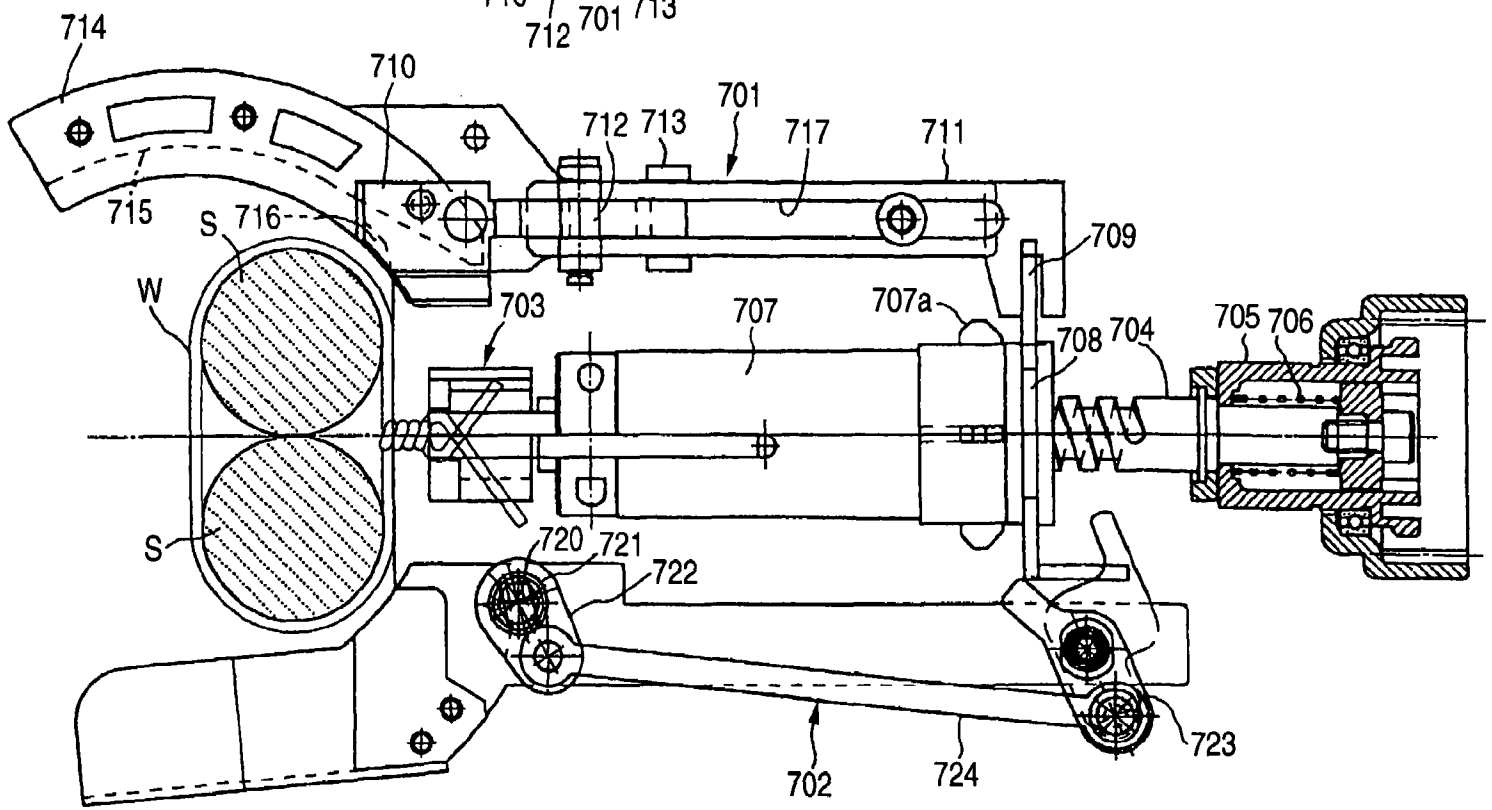
Figures 44A, 44B:
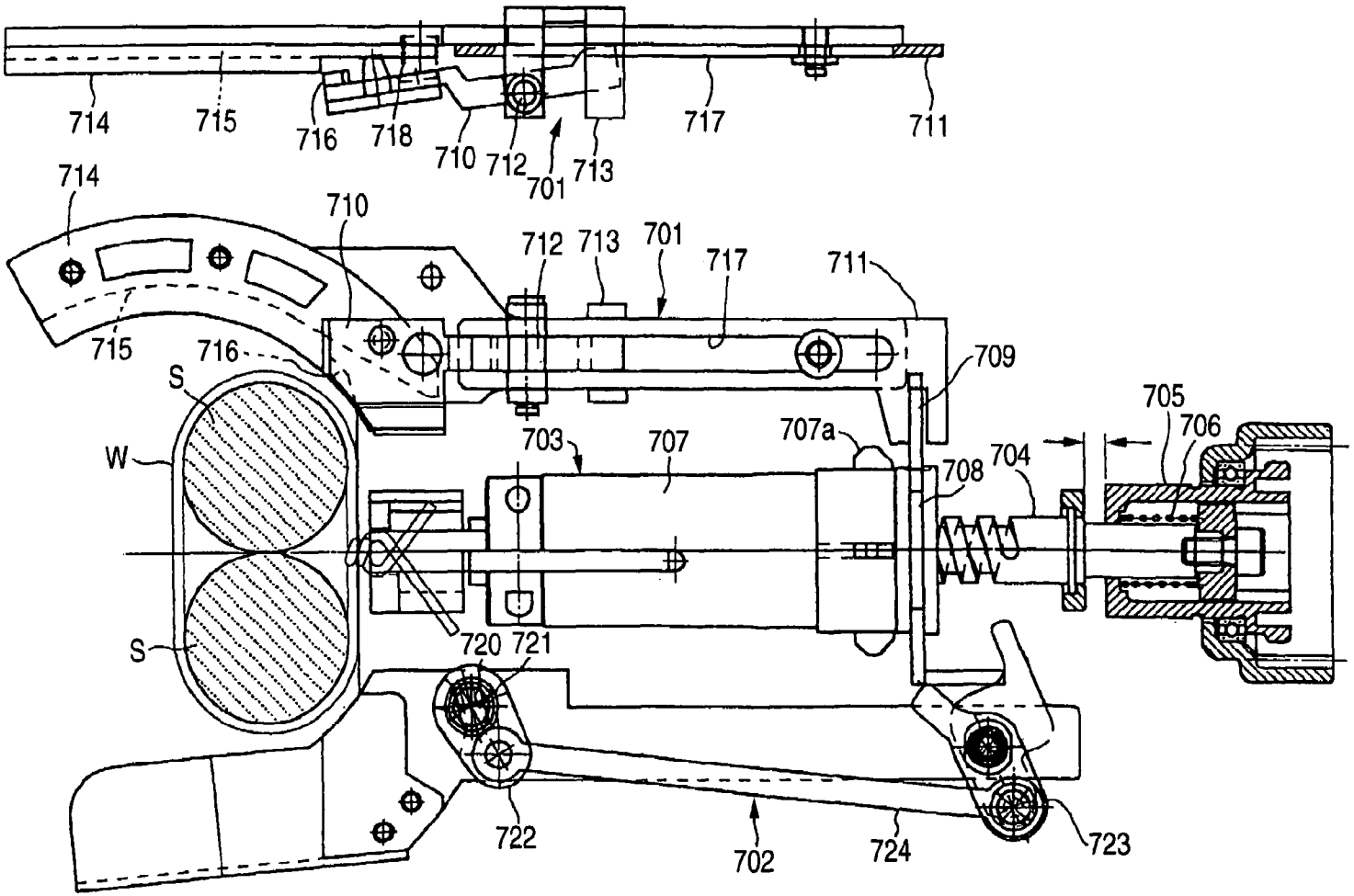
FIG. 44(*a*) and FIG. 44(*b*) show a step of twisting the binding line of the reinforcing bar binder, FIG. 44(*a*) is a plane view of the binding line guide apparatus and FIG. 44(*b*) is a side view of the reinforcing bar binder.

FIGS. 43(*a*) and 43(*b*) show a state of finishing to twist and the twist motor is stopped to drive by detecting an increase in the load of rotating the twist motor by a current detecting circuit. Although a length of a twist margin of the wire W is varied by large or small of the diameter of the reinforcing bar S, elongation of the binding line or the like, when the twist margin is short, as shown by FIG. 44(*a*) and FIG. 44(*b*), the ball screw shaft 704 and the binding line clamp apparatus 703 are moved forward by compressing the compression coil spring 706 at inside of the drive shaft 705 and the wire is prevented from being cut by limiting the tension in accordance with the length of the wire.

Figures 45A, 45B:
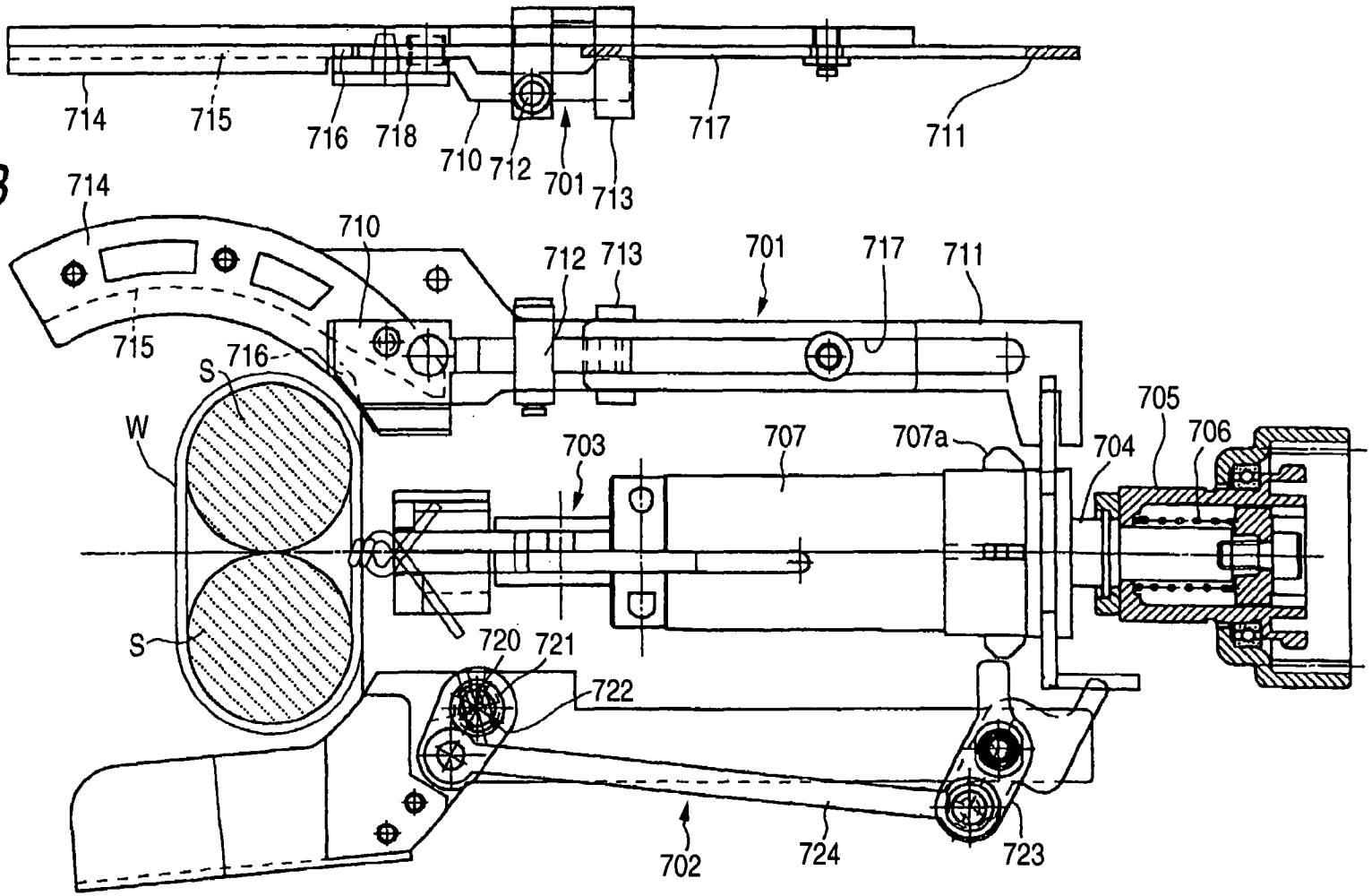
FIG. 45(*a*) and FIG. 45(*b*) show a step of releasing the biding line of the reinforcing bar binder, FIG. 45(*a*) is a plane view of the binding line guide apparatus and FIG. 45(*b*) is a side view of the reinforcing bar binder.

Further, after finishing to twist, the twist motor is reversely driven to rotate and the as shown by FIG. 45(*a*) and FIG. 45(*b*), the binding line guide apparatus 701, the binding line cut apparatus 702 and the binding line clamp apparatus 703 return to initial positions and the left and right clamp plates 726, 727 are opened to release the wire W.

Further, the invention is not limited to the above-described embodiment, although in the above-described embodiment, the guide plate 710 of the binding line guide apparatus 701 is constituted to pivot by constituting the fulcrum by the shaft 712, there may be constructed a constitution in which the guide plate 710 is mounted to a slide guide in the lateral direction and is moved by the slide cam plate 711 in parallel therewith. Further, there may be constructed a constitution of moving the guide plate 710 by using an actuator or the like in place of the cam mechanism, there may be constituted a type of moving the guide plate by detecting an amount of feeding the wire by various sensors or the like, the invention can be modified variously within the technical range of the invention and the invention naturally covers modified embodiments thereof.

The application is based on Japanese Patent Application (Japanese Patent Application No. 2001-225202) filed on Jul. 25, 2001, Japanese Patent Application (Japanese Patent Application No. 2001-230654) filed on Jul. 30, 2001, Japanese Patent Application (Japanese Patent Application No. 2001-230666) filed on Jul. 30, 2001, Japanese Patent Application (Japanese Patent Application No. 2001-230672) filed on Jul. 30, 2001 and Japanese Patent Application (Japanese Patent Application No. 2001-250911) filed on Aug. 21, 2001 and contents thereof are incorporated here by reference.

INDUSTRIAL APPLICABILITY

As has been explained above, the reinforcing bar binder of the invention is constituted to pinch the front and the rear end of the binding line loop by the clamp plates to twist in place of the constitution of the prior art hanging the hooks to the binding line loop to twist and therefore, extra projected portions of the binding line after twisting are hardly present and finish is promoted.

Further, by constituting to twist the binding line by corresponding the loop length of the binding line to the diameter of the reinforcing bar by pulling back the binding line after forming the binding loop, a time period required for twisting is shortened, performance of bringing the reinforcing bar and the binding line into close contact with each other is improved to stabilize the binding strength and also an amount of consuming the binding line is reduced.

Further, by forming the inclined face portions or the projected portions which are brought into contact with the upper end face or the lower end face of the center clamp plate in clamping at the left and right clamp plates, in clamping the binding line, the both end portions of the binding line can be bent to deform to clamp solidly.

Further, the binding line clamp line apparatus of the reinforcing bar binder of the invention is constituted to pinch the front end and the rear end of the binding line loop by the clamp plate to twist in place of the constitution of the prior art hanging the hooks to the binding line loop to twist and therefore, extra projected portions of the binding line after twisting are hardly present, finish is promoted and also the amount of consuming the binding line is reduced.

Further, the binding line clamp apparatus of the reinforcing bar binder of the invention is constituted to pinch the binding line by the clamp plate to twist in place of the constitution of the prior art hanging the hooks to the binding line loop to twist, the front end of the binding line moved between the clamp plates impinges on the stopper portion formed at the clamp plate to stop and therefore, the front end and the rear end of the binding line loop can be pinched to twist, extra projected portions of the binding line after twisting are hardly present, finish is promoted and also the amount of consuming the binding line is reduced.

Further, the binding line clamp apparatus of the reinforcing bar binder of the invention is constituted to pinch the front end and the rear end of the binding line loop by the clamp plate to twist in place of the constitution of the prior art hanging the hooks to the binding line loop to twist and therefore, extra projected portions of the binding line after twisting are hardly present, finish is promoted and also the amount of consuming the binding line is reduced.

Further, the binding line is clamped by spring pressure and therefore, the clamp pressure stays to be substantially constant regardless of the wire diameter of the binding line, the grasping force is stabilized, the binding line is slid among the clamp plates in accordance with a tensile stress and a torsional stress of the binding line and therefore, the binding line is not excessively applied with the load and a concern of accidentally cutting the binding line is also resolved.

Further, according to the reinforcing bar binder of the invention, the guide plate firmly forms the binding line in the loop shape by supporting the inner peripheral side of the binding line in the step of feeding out the binding line, the guide plate is constituted to escape from the path of the binding line after feeding out the binding line, thereby, the twisting operation can be carried out pertinently and excellently without being hindered by the forming portion. Further, the binding line cut apparatus can be arranged at a pertinent position regardless of the position of the forming portion and can be arranged immediately before the binding line grasp mechanism. Thereby, both ends of the free end of the cut binding line and the free end of the binding line loop previously fed can be grasped to twist, further, the binding line can be wound around the reinforcing bar by 1 turn to bind and therefore, in comparison with the constitution of the prior art binding the binding line by 2 turns or more, the amount of consuming the binding line is considerably reduced and an outlook thereof is also excellent.

Further, after feeding the binding line, the binding line is pulled back by escaping the binding line feed plate from the path of the binding line, the binding line can be brought into close contact with the reinforcing bar without being hindered by the forming portion, the length of the binding line is adjusted in accordance with the boldness of the reinforcing bar and when the twisting operation is carried out thereafter, the extra portion of the binding line can be eliminated, the amount of consuming the binding line can further be reduced and excellent binding finish can be achieved.

What is claimed is:

1. A binding line clamp apparatus, for a reinforcing bar binder that grasps and twists a loop of binding line fed out by a binding line mechanism to a surrounding of a reinforcing bar, comprising:

a center clamp plate;

a right clamp plate arranged on a right side of the center clamp plate;

a left clamp plate arranged on a left side of the center clamp plate;

a sleeve outwardly mounted to the center clamp plate, the right clamp plate and the left clamp plate; and a pair of cam mechanisms including cams and guide pins, and provided to respective of the sleeve and the right clamp plate and the sleeve and the left clamp plate;

wherein the right clamp plate and the left clamp plate are opened and closed in accordance with movement of the sleeve in a front and rear direction, and the binding line is fed out by passing through one of an interval between the right clamp plate and the center clamp plate and an interval between the left clamp plate and the center clamp plate, by the binding line feed mechanism, and after introducing a front end of the binding line formed in a shape of a loop through the other of the interval between the right clamp plate and the center clamp plate and the interval between the left clamp plate and the center clamp plate, the binding line is grasped by closing the right clamp plate and the left clamp plate.

2. The binding line clamp apparatus according to claim 1, wherein the right clamp plate is brought into elastic contact with the center clamp plate by a first spring, and the left clamp plate is brought into elastic contact with the center clamp by a second spring.

3. The binding line clamp apparatus according to claim 1, wherein the binding line feed mechanism feeds out the binding line passing through one of the interval between the right clamp plate and the center clamp plate and the interval between the left clamp plate and the center clamp plate to a guide groove formed at a nose of the reinforcing bar binder.

4. The binding line clamp apparatus according to claim 3, wherein the nose of the reinforcing bar binder is constituted by a circular arc shape.

5. The binding line clamp apparatus according to claim 1, wherein the cams of the cam mechanism are constituted by groove cams.

6. The binding line clamp apparatus according to claim 1, wherein the respective of the sleeve and the right clamp plate and the sleeve and the left clamp plate are connected by the cam mechanisms.

7. The binding clamp apparatus according to claim 1, wherein the cams of the pair of cam mechanisms are respectively formed at at least one of the sleeve and the right clamp plate and the sleeve and the left clamp plate, and wherein phases of the pair of cams are shifted from each other, and after grasping the front end of the loop of the binding line by the one of the right clamp plate and the left clamp plate, the other of the right clamp plate and the left clamp plate grasps a rear end of the loop of the binding line.

8. The binding line clamp apparatus according to claim 1, wherein a stopper portion projected in a center direction is formed on an upper portion of a face of grasping the binding line of the right clamp plate and the left clamp plate, and the front end of the binding line impinges on the stopper portion to stop.

9. The binding line clamp apparatus according to claim 1, wherein a guide groove of the binding line is formed on a face of grasping the binding line of one of the right clamp plate and the left clamp plate constituting a side of feeding out the binding line.

10. A reinforcing bar comprising:

a binding line feed mechanism that feeds out a binding line in a shape of a loop to wind around a reinforcing bar;

a grasping portion that grasps the binding line wound around the reinforcing bar, and includes a center clamp plate, a right clamp plate arranged on a right side of the center clamp plate, and a left clamp plate arranged on a left side of the center clamp plate;

right and left cams to move the right and left clamp plates, wherein phases of the right and left cams are shifted from each other;

a binding line twist mechanism that twists the binding line to bind the reinforcing bar by driving to rotate the grasping portion;

wherein the right clamp plate and the left clamp plate are arranged to open and close linearly relative to the center plate; and wherein the binding line fed out by the binding line feed mechanism is passed through one of an interval between the right clamp plate and the center clamp plate and an interval between the left clamp plate and the center clamp plate, and wherein the right clamp plate and the left clamp plate are closed to grasp the loop of the binding line fed out thereby, after a front end of a loop of binding line is introduced into the other interval.

11. The reinforcing bar binder according to claim 10, wherein after grasping a front end of the loop of the binding line by closing the one of the right clamp plate and the left clamp plate constituting a side of grasping the front end of the loop of the binding line, the binding line is pulled back by reversely driving to rotate the binding line feed mechanism, and a length of the loop of the binding line is adjusted in accordance with a diameter of the reinforcing bar.

12. The reinforcing bar binder according to claim 10, wherein one of an inclined face portion and a projected portion, that is brought into contact with an upper end face or a lower end face of the center clamp plate when the binding line is clamped, is formed on one of the right clamp plate and the left clamp plate, and wherein when the binding line is clamped, the binding line is bent and deformed.

13. A reinforcing bar binder comprising:

a nose including a guide groove at an inner periphery thereof;

a feed mechanism that feeds out a binding line along the guide groove to wind around a reinforcing bar;

a grasp mechanism that grasps the binding line wound around the reinforcing bar;

a twist mechanism that twists the binding line to bind the reinforcing bar by driving to rotate the grasp mechanism;

a guide plate that contacts with the binding line fed along the guide groove by the feed mechanism, and curls the binding line; and a shaft, wherein the guide plate is pivotable around the shaft so as to move between the position opposed to the guide groove and the position separated from the guide groove, wherein the guide plate is formed movably to a position opposed to the guide groove and a position separated from the guide groove; and wherein the nose does not fully enclose the reinforcing bar during operation of the reinforcing bar binder.

14. The reinforcing bar binder according to claim 13, wherein in a step of feeding out the binding line, the guide plate is opposed to the guide groove, and curls the binding line brought into contact with the guide plate, and after the step of feeding out the binding line, the guide plate is moved to the position separated from the guide groove, the binding line is pulled back by reversely driving to rotate the feed mechanism, and a length of the binding line is controlled in accordance with a diameter of the reinforcing bar.

15. A reinforcing bar binder comprising, a nose including a guide groove at an inner periphery thereof;

a feed mechanism that feeds out a binding line along the guide groove to wind around a reinforcing bar;

a grasp mechanism that grasps the binding line wound around the reinforcing bar;

a twist mechanism that twists the binding line to bind the reinforcing bar by driving to rotate the grasp mechanism;

a guide plate that contacts with the binding line fed along the guide groove by the feed mechanism, and curls the binding line;

a slide cam plate that drives the guide plate; and a sleeve that drives the grasp mechanism and the twist mechanism, wherein the slide cam plate moves integrally with the sleeve, wherein the guide plate is formed movably to a position opposed to the guide groove and a position separated from the guide groove; and wherein the nose does not fully enclose the reinforcing bar during operation of the reinforcing bar binder.

* * * * *